US009150997B2

(12) United States Patent
Seo et al.

(10) Patent No.: US 9,150,997 B2
(45) Date of Patent: Oct. 6, 2015

(54) HOME APPLIANCE INCLUDING STEAM GENERATOR AND CONTROLLING METHOD OF THE SAME

(75) Inventors: Bosung Seo, Seoul (KR); Myunghun Im, Seoul (KR); Sooyoung Oh, Seoul (KR); Changoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 349 days.

(21) Appl. No.: 13/590,679

(22) Filed: Aug. 21, 2012

(65) Prior Publication Data

US 2013/0048626 A1 Feb. 28, 2013

(30) Foreign Application Priority Data

Aug. 22, 2011 (KR) ..... 10-2011-0083699
Aug. 22, 2011 (KR) ..... 10-2011-0083700

(51) Int. Cl.

| | |
|---|---|
| ***D06F 39/00*** | (2006.01) |
| ***D06F 33/02*** | (2006.01) |
| ***F22B 1/28*** | (2006.01) |
| *A47L 15/42* | (2006.01) |
| *D06F 58/20* | (2006.01) |
| *D06F 58/28* | (2006.01) |

(52) U.S. Cl.

CPC ..... *D06F 39/008* (2013.01); *D06F 33/02* (2013.01); *F22B 1/284* (2013.01); *A47L 15/4234* (2013.01); *D06F 58/203* (2013.01); *D06F 58/28* (2013.01); *D06F 2058/2896* (2013.01); *D06F 2202/12* (2013.01); *D06F 2204/10* (2013.01)

(58) Field of Classification Search

CPC .... A47L 15/4234; D06F 39/008; F22B 1/284
See application file for complete search history.

(56) References Cited

U.S. PATENT DOCUMENTS

| | | | | |
|---|---|---|---|---|
| 4,724,824 | A * | 2/1988 | McCoy et al. | 392/396 |
| 5,265,318 | A * | 11/1993 | Shero | 392/399 |
| 6,058,247 | A * | 5/2000 | Lahey et al. | 392/399 |
| 7,577,343 | B2 * | 8/2009 | Chiang | 392/399 |
| 7,669,591 | B2 * | 3/2010 | Fossati et al. | 126/348 |
| 7,801,424 | B2 * | 9/2010 | Cheung | 392/399 |
| 7,913,339 | B2 * | 3/2011 | Wong et al. | 8/149.3 |
| 7,989,737 | B2 * | 8/2011 | Jeon et al. | 219/401 |
| 2006/0096333 | A1 * | 5/2006 | Park et al. | 68/15 |
| 2009/0139550 | A1 * | 6/2009 | Lim | 134/107 |
| 2009/0151400 | A1 * | 6/2009 | Park | 68/5 |

(Continued)

FOREIGN PATENT DOCUMENTS

| | | | |
|---|---|---|---|
| CN | 1769772 | A | 5/2006 |
| CN | 1948601 | A | 4/2007 |

(Continued)

*Primary Examiner* — Joseph M Pelham
(74) *Attorney, Agent, or Firm* — Dentons US LLP

(57) ABSTRACT

Embodiments may relate to a home appliance, more specifically, to a washing apparatus having a steam generator and a controlling method of the same and embodiments may relate to a home appliance including a steam generator. according to one embodiment of the present invention, a home appliance includes a steam generator configured to generate steam to supply the generated steam to an object accommodation part where an object is accommodated, wherein the steam generator includes a housing configured to accommodate water supplied thereto; a heater configured to heat the water accommodated in the housing by heating the housing to generate steam; and a control unit configured to cut off or apply an electric power of the heater based on the temperature of the housing.

17 Claims, 19 Drawing Sheets

(56) References Cited

U.S. PATENT DOCUMENTS

| | | | | |
|---|---|---|---|---|
| 2010/0142935 | A1* | 6/2010 | Kim et al. | 392/394 |
| 2011/0185512 | A1 | 8/2011 | Lee | |
| 2013/0047346 | A1* | 2/2013 | Im et al. | 8/137 |
| 2013/0048626 | A1* | 2/2013 | Seo et al. | 219/510 |

FOREIGN PATENT DOCUMENTS

| | | | |
|---|---|---|---|
| CN | 101290111 | A | 10/2008 |
| CN | 101304718 | A | 11/2008 |
| CN | 101649536 | A | 2/2010 |
| EP | 1655408 | A1 | 5/2006 |
| EP | 1887123 | A1 | 2/2008 |
| EP | 1889966 | A2 | 2/2008 |
| EP | 1959046 | A1 | 8/2008 |
| EP | 2 287 390 | A1 | 2/2011 |
| JP | 2010-159919 | A | 7/2010 |
| KR | 1020060040437 | A | 5/2006 |
| KR | 10-2007-0059429 | A | 6/2007 |
| KR | 10-2008-0003021 | A | 1/2008 |
| KR | 10-2009-0004064 | A | 1/2009 |
| WO | 2011/064149 | A1 | 6/2011 |

* cited by examiner

HOME APPLIANCE INCLUDING STEAM GENERATOR AND CONTROLLING METHOD OF THE SAME

CROSS-REFERENCE TO RELATED APPLICATION

Pursuant to 35 U.S.C. §119(a), this application claims the benefit of earlier filing date and right of priority to Korean Applications No. 10-2011-0083699, filed on Aug. 22, 2011 and No. 10-2011-0083700, filed on Aug. 22, 2011, the contents of which are hereby incorporated by reference herein in their entirety.

BACKGROUND

1. Field

Embodiments of the present invention may relate to a home appliance like a washing apparatus, more specifically, to a washing machine having a steam generator and a controlling method of the same, and embodiments of the present invention may relate to a home appliance including a steam generator and a controlling method of the same.

2. Background

The present invention relates to a home appliance, in particular to a washing machine which is a representative example of a home appliance and a dryer is another example. In addition, a washer-dryer having washing and drying functions capable of washing and drying laundry may be an additional example of a home appliance.

Recently, a refresher for refreshing clothes by using heated air or steam, not washing clothes by using water has been released and such a refresher may be an example of the home appliance.

A dishwasher for washing dishes, not clothes, may be also an example of a home appliance in a broad sense. In the present specification, a home appliance includes all kinds of washing apparatuses including all the devices mentioned above.

In this instance, a steam generator provided in such a washing apparatus is a mechanism for generate and supply steam to objects such as clothes or dishes. The steam is employed as a heat source for heating an object and a moisture supply source for supplying moisture to an object. Accordingly, such functions may be expanded and applied to various home appliances as well as a washing apparatus.

The washing machine will be described as representative example of the washing apparatus in the present specification. Unless exclusive and contradictory with the other devices, the present invention may be applicable to the other type washing apparatuses and electric home appliances.

The steam generator is provided in a washing machine and it generates high temperature steam. The steam generator supplies the steam in cycles of washing to improve a washing effect. Also, the steam generator is provided in a washing apparatus having a drying function, namely, a washing apparatus such as a dryer or a refresher and it removes wrinkles and unpleasant smell. Accordingly, the steam generator can be employed as a refresher capable of refreshing clothes to make a user feel like new clothes.

A conventional steam generator for a washing machine according to the prior art will be describe as follows.

FIG. 1 is a perspective view schematically illustrating a structure of a drum washing machine. FIG. 2 is a perspective view schematically illustrating a steam generator according to the prior art. FIG. 3 is a cut-away perspective view of the steam generator shown in FIG. 2, seen at a different another angle.

As shown in FIG. 1, a drum washing machine having a conventional steam generator includes a case 10 for defining an exterior appearance thereof, a cylindrical tub 12 horizontally oriented in the case 10 to hole wash water, a drum 14 rotatably mounted in the tub 12, and a steam generator 16 configured to supply steam to the inside of the drum 14.

In this instance, the drum is an accommodation part for accommodating washing objects, namely, clothes and so on. A drum provided in the dryer may accommodate clothes and so on as drying objects. Similarly, dry clothes are accommodated in an object accommodation part for refreshing. Accordingly, the accommodation part may be expanded and variable according to the appearance thereof, the kind of an object and a function and an appearance of an electric home appliance. In other words, such the accommodation part may be expanded variously to an accommodation part for accommodating dishes, an accommodation part for accommodating clothes to perform refreshing and an inner tub of a pulsator washing machine.

In a front surface of the case 10 is formed an opening 18 in communication with the inner space of the drum to load and unload laundry. A door 20 is rotatable forwardly to open and close the opening 18.

Meanwhile, a water supply valve 22 and a water supply hose 24 are provided in a predetermined portion of the case 10 to supply water to the steam generator 16.

Also, a steam supply pipe is connected to the steam generator 16 as a passage to guide the steam generated in the steam generator 16 into the drum 14 to inject the steam.

Referring to FIGS. 2 and 3, the steam generator 16 will be described in detail as follows.

The steam generator 16 includes a lower case 28 for defining a predetermined space to store water therein, an upper case 30 coupled to a top of the lower case 28 and a heater 32 configured to heat the water stored in the steam generator 16.

In the upper case 30 may be provided a water inlet to supply water to the steam generator from the water supply hose 24 and a steam outlet 36 to exhaust the steam generated in the steam generator 16 to the steam supply pipe 26.

Meanwhile, the heater 32 is mounted in a lower portion of the lower case 28, in parallel to a bottom surface of the lower case 28. When water is supplied to the steam generator 16, the heater 32 is put into operation for heating water in a state of being submerged in the water.

The mounting structure of the heater will be described more specifically as follows.

As shown in FIG. 3, the heater 23 is inserted in the inner space of the rectangular-shaped case through a lateral surface having a small area out of lateral surfaces of the cases 28 and 30, in parallel with the bottom surface of the case. The lateral surfaces are sealed airtight to prevent water leakage and an electric power is supplied to the heater via a terminal 35.

Meanwhile, a bracket 33 is provided on the bottom surface of the lower case 28 and the heater is fixedly inserted in the bracket 33.

Accordingly, an end of the heater 32 is fixed to the bracket 33 and the other end thereof is fixed to a lateral surface of the case.

A water level sensor 40 is provided in a predetermined portion of the upper case 30 to detect a water level of the water stored in the steam generator 16. A temperature sensor 42 is provided in a center portion of the upper case 30 to measure the temperature of the water heated by the heater 32 and the temperature of the steam.

The water level sensor 40 includes a high level electrode bar 40*c* and a low water level electrode bar 40*b* for sensing high water levels and low water levels, respectively, and a common electrode bar 40*a*. In addition, partition walls 45 and 46 may be provided to surround the water level sensor and the partition walls are employed to maintain the sensed water levels and to perform a function of reducing a deviation of sensed levels.

The conventional steam generator having the structure mentioned above will be operated as follows.

First of all, when a washing cycle of the washing machine starts, water is supplied to the inner space of the steam generator 16 via the water inlet 34.

The water drawn into the steam generator 16 is heated by the heater 32 and converted into steam. The steam is drawn into the drum 14 accommodating the washing objects via the steam outlet 36 and it performs wetting and soaking processes for the laundry, to enhance washing efficiency.

In this instance, the steam exhausted via the steam outlet 36 is a high temperature steam. When an exhaustion valve that is able to be open and closed by the pressure of the steam is provided in front or behind the steam outlet, the steam exhausted via the steam outlet may be high temperature and high-pressure steam. However, the steam may be supplied to the drum by the pressure thereof.

Meanwhile, once the wetting and soaking process for the laundry is completed, the operation of the steam generator 16 is completed and a series of cycles are performed to finish the washing of the laundry.

However, the conventional steam generator 16 for the washing machine has a disadvantage of unnecessarily large volume. A large area surface of the heater 32 is installed in parallel with the bottom surface of the lower case 28 and the length of the steam generator 16 cannot help but be increased.

Accordingly, the overall volume of the steam generator 16 is increased only to enlarge the profile of the washing machine. In addition, the production cost happens to arise and it is difficult to apply the steam generator to the other types of washing machines or electric home appliances as well as the washing machine.

Moreover, to install the steam generator having the conventional arrangement of the heater 32 in a washing machine or dryer having a low capacity, the entire profile of the washing machine or dryer has to be enlarged unnecessarily. Also, the unnecessarily large capacity steam generator is installed and the steam generating efficiency might be deteriorated accordingly.

Meanwhile, a water surface is formed broad in the steam generator and the steam or hot water could be supplied to the laundry loaded in the drum 14. Accordingly, damage to fabric of the laundry happens.

Also, bubbles generated by water heating might interfere with the electrode of the water level sensor 40 to generate noise in the signal sensed during the sensing the water level. Accordingly, the water level sensor 40 might be malfunctioned.

The steam generator 16 has following structural disadvantages.

As shown in FIG. 3, the water level sensor 40 senses the high water level (A) and the low water level (B) to protect the steam generator from the overheating of the heater. In this instance, the heater starts heating at the high water level (A) and stops the heating at the low water level (B). Accordingly, it can be said that the water filled with a predetermined space (C) between the high water level (A) and the low water level (B) is changed into steam. However, the water heated to generate the steam includes the water filled with the space (D) to the low water level (B). The water filled with the space (D) is heated but not changed into steam. Accordingly, energy and water waste might be generated. In other words, all of the water inside the steam generator is heated to protect the heater but not be changed into steam, such that energy and water waste might be generated.

Also, the heater has to be installed, spaced apart a predetermined distance from a lower surface of the lower case, because the quantity of heat transmitted to the lower case from the heater has to be reduced in case of overheating. Accordingly, a large amount of water might be wasted unnecessarily to satisfy the heater protection water level.

Such heater protection water level means too much capacity of the steam generator mentioned above and it means that it takes a long time to generate the steam. In other words, the heater protection water level means that it takes a long time to generate the steam after the heating starts and that it takes a long time to perform a steam cycle.

For example, it is a recent trend to shorten the duration time of the washing, with enhancing washing efficiency. For example, a washing course proposes that it should be 50 minutes to finish a final drying-spinning cycle after a washing cycle of the washing course starts. In such a washing course, the washing cycle may be performed proximately for 10 to 15 minutes. However, it takes quite a lot of time for the steam generator mentioned above to generate the steam and it is difficult to apply the steam to such washing course. That is because the washing cycle could finish just when the steam starts to be supplied after water is heated.

Of course, it is possible to apply the steam cycle during the washing cycle composing such the washing course. However, in this instance, that steam cycle might lengthens the overall washing cycle and the time taken to perform the washing course might be lengthened. Accordingly, the user has to endure the long time of the washing course after adding the steam cycle.

Meanwhile, the steam generator 16 has to sense the low water level (B) or the heater protection water level precisely to prevent the overheating of the heater, such that re-water supply and heater control may be enabled.

However, the algorithm for sensing the water level could be complex and the structure of the partition wall 45 and 46 is required. The water level sensor, the structure for sealing the heater bracket 45 and with the heater to fix the heater, the plastic injection molding case 28 and 30 which can endure the high temperature and the capacity of the steam generator might increase the production cost of the steam generator disadvantageously.

Moreover, there is limitation on expanding the heat generation area because the heater 32 is installed adjacent to the bottom surface of the steam generator. Accordingly, heat efficiency deterioration might be generated by scale as the heater 32 is used. Especially, the water is getting close to the low water level, water splashing might be generated near the heater and the heated water, not the steam, might be supplied to the inside of the drum.

Also, the heater 32 is directly submerged in the water and there is concern of heater corrosion. To solve such heater corrosion, the heater 32 has to be formed of a stainless material and the unit cost of production might be increased.

Meanwhile, there is a pipe type steam generator that generates steam by heating the water flowing along a passage, not by heating the accommodated water. Such a pipe type steam generator is disclosed in U.S. Pat. No. 7,913,339A, EP 2287390A1, and International Publication No. WO2008/014924A1. However, such the pipe type steam generator has to change water into steam by heating flowing water. Accordingly, the amount of the supplied water and the amount of the steam has to be limited. In other words, when too much water is supplied via a passage, a predetermined amount of the supplied water might be supplied to an object accommodation part, failing to be changed into steam. Accordingly, clothes might be damaged. Because of such limitation, the water supply time and the amount of the supplied water cannot help but be substantially short and small in the pipe type steam generator. Accordingly, the water supply and the heating have to be performed by the heater quite often disadvantageously.

Specifically, the amount of the flowing water or the time of the water supply has to be controlled for outlet of pure steam in the pipe type steam generator. In the prior applications mentioned above, a flow controller for measuring a flow rate is necessary to control the amount of the flowing steam, or an algorithm for measuring the water supply time is necessarily provided. To provide the flow controller for measuring the flow rate, the configuration of the steam generator has to be complex and control components have to be quite complex. When the flow rate is controlled by the flow controller, the water pressure might be decreased. When the flow rate is controlled by the water supply time, the reliability of the flowing amount supplied according to the water pressure of a water supply source might be deteriorated.

Also, the pipe type steam generator converts the water flowing along the passage into steam. Accordingly, the passage has to be relatively narrow and scale might accumulate on the passage only to cause a problem of plugged passage occasionally. To solve the problem, an auxiliary algorithm for removing the scale can be embodied. However, there is limitation on the user's implementing such algorithms one by one. That is because a steam cycle is not always implemented in an electric home appliance, especially, a washing machine or dryer.

Such the pipe type steam generator basically performs water supplying and heating at the same time. Accordingly, to enable the steam generator to supply pure steam water supply has to be performed intermittently, not continuously. Because of that, steam supply has to be performed intermittently. In other words, it is difficult to supply a large amount of steam continuously and there is a problem of deteriorated efficiency for water supplying and heating to supply steam accordingly. That is because steam has to be supplied to an entire area inside the drum, not to a specific area, in a washing machine or a dryer.

SUMMARY

Accordingly, the embodiments may be directed to a home appliance including a steam generator and a controlling method of the same. To solve the problems as mentioned above, an object of the present invention is to provide a home appliance including a steam generator that is able to enhance steam generation efficiency and to be applied to various versions of a product, with a compact design.

Another object of the present invention is to provide a steam generator that is able to prevent high temperature water from being supplied to an inside of a drum there through and to prevent an error of a water level sensor. For that, the steam generator according to the embodiments of the present invention may omit the water level sensor or at least a low water level sensing sensor. Also, a heater controlling algorithm related to the water level sensor is omitted and the steam generator according to the embodiments is able to control the heater precisely and stably.

According to the embodiments of the present invention, the structure of the bracket provided to fix the heater in the steam generator, the sealing structure of the heater, the material of the steam generator, a heating area of the heater and the control unit may be improved or transformed or omitted to provide the steam generator having the cost reduction and enhanced efficiency. A home appliance with convenient usage and reduced production cost may be provided.

According to the embodiments of the present invention, an initial driving pattern of the steam generator is differentiated according to the selected course. A steam generator that is able to minimize damage to the object and a home appliance having such a steam generator.

According to the embodiments of the present invention, the steam generation time may be effectively reduced and the overall time taken to perform the steam cycle may be reduced. Accordingly, the overall operation time of the home appliance which might be increased by the steam cycle may be prevented from increasing.

The embodiments of the present invention may provide a steam generator that is more safe and stable and a home appliance including such a steam generator.

According to the embodiments of the present invention, the steam cycle may be effectively performed even at a low water supply pressure.

To achieve these objects and other advantages and in accordance with the purpose of the embodiments, as embodied and broadly described herein, a home appliance includes a steam generator configured to generate steam to supply the generated steam to an object accommodation part where an object is accommodated, wherein the steam generator includes a housing configured to accommodate water supplied thereto; a heater configured to heat the water accommodated in the housing by heating the housing to generate steam; and a control unit configured to cut off or apply an electric power of the heater based on the temperature of the housing. A washing machine may be a representative example of the home appliance.

The control unit may cut off the power of the heater when the temperature of the housing reaches a first preset temperature that is over a boiling point of water.

The control unit may include a control signal generator provided adjacent to a side of the housing and configured to generate a heater power control signal based on the temperature of the housing and a heater controller configured to cut off or apply the power of the heater based on the control signal.

The control signal generator may generate a heater power cut off signal when the temperature of the housing reaches a first preset temperature, and the heater controller may cut off the power supplied to the heater based on the heater power cut off signal.

The control signal generator may generate a heater power applying signal when the temperature of the housing is lowered to a second preset temperature from the first preset temperature, and the heater controller may apply the power supplied to the heater based on the heater power applying signal.

Here, the second preset temperature is over the boiling point of water but lower than the first preset temperature.

The control unit may control water to be supplied to the housing when the temperature of the housing reaches the first preset temperature that is over the boiling point of water.

The heater may be embedded in the housing.

The housing may include a base for defining a bottom surface and a sidewall coupled to a lateral surface of the base to form a heating space where the water accommodated in the housing is heated, and the heater may be embedded in the base.

The heater may include at least two heater terminals having the power connected thereto and a heating line provided between the heater terminals to emit heat to heat the housing, and the heating line may be embedded in the base and the heater terminals are provided in the same lateral surface of the base.

The home appliance may further include an overheat preventer provided in the housing to cut off the power supplied to the heater when the temperature of the housing reaches a third preset temperature that is the first preset temperature or higher.

The overheat preventer may be connected to the line of the power supplied to the heater in serial to cut off the power supplied to the heater, regardless of the control performed by the control unit, when the temperature of the housing reaches the third preset temperature.

The heater controller may include a heater switch provided on the line of the power supplied to the heater to selectively cut off or apply the power supplied to the heater; and a controller configured to control the heater switch based on the control signal of the control signal generator.

The overheat preventer may include a first overheat preventer connected between the heater switch and the heater in serial.

The overheat preventer may include a second overheat preventer connected between the controller and the heater in serial.

The overheat preventer may be a thermostat.

The control signal generator may be a thermostat.

The control unit may cool the housing by supplying water to the housing for a predetermined time, when a steam cycle performed by the steam generator finishes after a predetermined condition is satisfied.

In another aspect of the present invention, a controlling method of a washing machine configured to perform a low water pressure compensating algorithm to supply a proper amount of water to a steam generator, the low water pressure compensating algorithm includes a water supply step configured to supply water to the steam generator for a preset water supply time; a power applying step configured to apply the power to a heater of the steam generator; a sensing time counting step configured to count the sensing time taken for the temperature of the housing to reach a first preset temperature that is over the boiling point of water, after the power of the heater is applied; and a determining step configured to determine the water pressure of a water supply source as a low water pressure when the sensing time is shorter than a preset time after the sensing time is compared with a preset time.

The controlling method of the washing machine may further include a water supply time compensating step configured to increase the water supply time by adding the compensated time to the water supply time when the water pressure of the water supply source is a low water pressure.

The low water pressure compensating algorithm may be re-performed according to the water supply time compensated in the water supply time compensating step, and the low water pressure compensating algorithm may finish when the sensing time is the preset time or longer.

The sensing frequency determined as the low water pressure in the determining step may be counted, and the water supply compensating step may be performed when the sensing frequency is a preset number of times or more.

The low water pressure compensating algorithm may be performed before a steam cycle of a selected course starts.

The low water pressure compensating algorithm may be performed, after the housing is heated by applying the power to the heater of the steam generator until the temperature of the housing is over the boiling point of water.

The heater may be embedded in the housing of the steam generator.

In a further aspect of the present invention, a home appliance includes a steam generator configured to generate steam to supply the generated steam to an object accommodation part where an object is accommodated, wherein the steam generator includes a housing configured to accommodate water supplied thereto; a heater configured to heat the water accommodated in the housing by heating the housing to generate steam; first thermostat provided in the housing to generate a heater power cut off signal when the temperature of the housing reaches a first preset temperature; and a second thermostat provided in the housing with being connected to a line of the power supplied to the heater in serial, to cut off the power supplied to the heater when the temperature of the housing reaches a third preset temperature that is over the first preset temperature.

In this instance, the home appliance may further include a heater controller configured to cut off the power supplied to the heater based on the heater power cut off signal.

The heater controller may include a controller; a heater switch to selectively cut off the power supplied to the heater based on the control of the controller. The second thermostat may be connected between the heater switch and the heater in serial.

A still further aspect of the present invention, a home appliance includes a steam generator configured to generate steam to supply the generated steam to an object accommodation part where an object is accommodated, wherein the steam generator includes a housing configured to accommodate water supplied thereto; a heater configured to heat the water accommodated in the housing by heating the housing to generate steam; and a control signal generator provided in the housing to generate a first signal when the temperature of the housing reaches a first preset temperature that is over the boiling point of water.

Also, a control unit may be further provided to cut off the water supplied to the steam generator or the power supplied to the heater based on the first signal.

The control unit may control water to be supplied to the housing based on the first signal.

The control unit may cut off the power of the heater based on the first signal.

The control unit may control water to be supplied to the housing after or simultaneously when cutting off the power of the heater based on the first signal.

The control signal generator may be a thermostat.

According to the embodiments of the present invention, there may be following advantageous effects. The embodiments of the present invention may provide a home appliance including a steam generator that is able to enhance steam generation efficiency and to be applied to various versions of a product, with a compact design, and a home appliance including the same.

The embodiments of the present invention may provide a steam generator that is able to prevent high temperature water from being supplied to an inside of a drum there through and to prevent an error of a water level sensor. For that, the steam generator according to the embodiments of the present invention may omit the water level sensor or at least a low water level sensing sensor. Also, a heater controlling algorithm related to the water level sensor is omitted and the steam generator according to the embodiments is able to control the heater precisely and stably.

According to the embodiments of the present invention, the structure of the bracket provided to fix the heater in the steam generator, the sealing structure of the heater, the material of the steam generator, a heating area of the heater and the control unit may be improved or transformed or omitted to provide the steam generator having the cost reduction and enhanced efficiency. A home appliance with convenient usage and reduced production cost may be provided.

According to the embodiments of the present invention, an initial driving pattern of the steam generator is differentiated according to the selected course. A steam generator that is able to minimize damage to the object and a home appliance having such a steam generator.

According to the embodiments of the present invention, the steam generation time may be effectively reduced and the overall time taken to perform the steam cycle may be reduced. Accordingly, the overall operation time of the home appliance which might be increased by the steam cycle may be prevented from increasing.

The embodiments of the present invention may provide a steam generator that is more safe and stable and a home appliance including such a steam generator.

According to the embodiments of the present invention, the steam cycle may be effectively performed even at a low water supply pressure.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
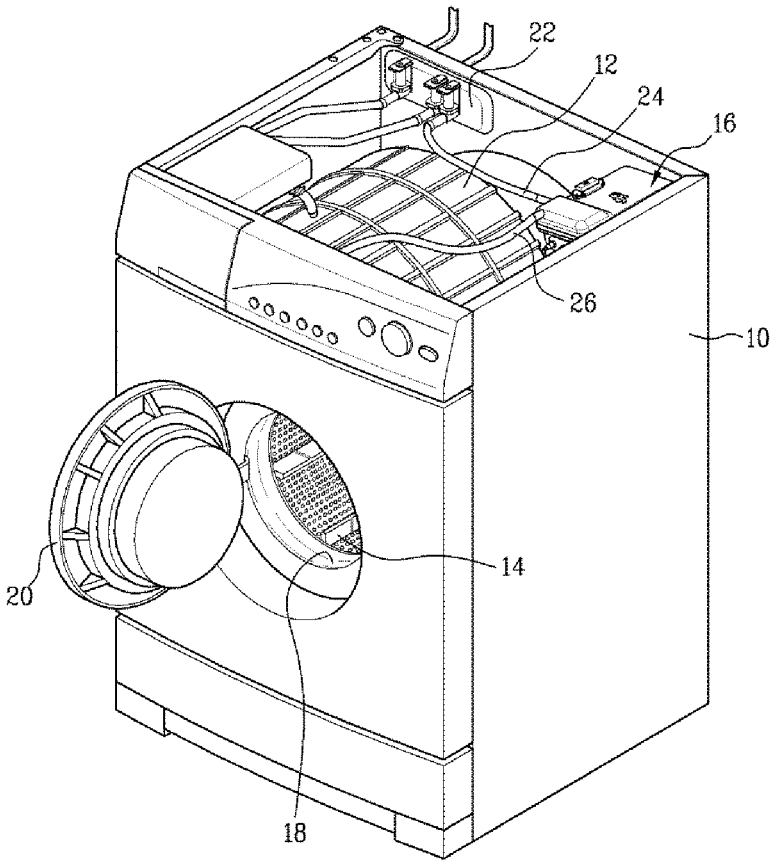
FIG. 1 is a perspective view schematically illustrating a structure of a conventional drum washing machine.
Figure 2:
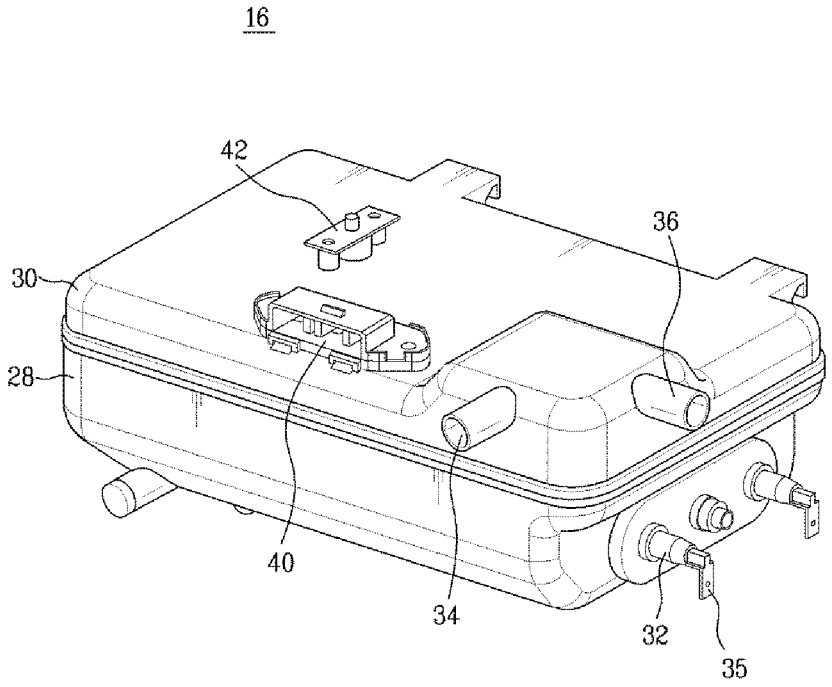
FIG. 2 is a perspective view schematically illustrating a steam generator according to the prior art.

Reference may now be made in detail to specific embodiments, examples of which may be illustrated in the accompanying drawings. Wherever possible, same reference numbers may be used throughout the drawings to refer to the same or like parts. Basically, a steam generator and a controlling method of the same will be described in detail as follows. Such embodiments may be applied to various electric home appliances including a washing machine. Such a home appliance may include a cabinet and an object accommodation part (for example, a drum) arranged in the cabinet to accommodate objects, as shown in FIG. 1. A steam generator may be provided outside the object accommodation part and the steam generator may be configured to generate steam to be supplied to the accommodation part. The steam generator may be located within the cabinet.

Referring to FIGS. 4 to 10, a steam generator according to one embodiment will be described in detail as follows.

The steam generator 100 includes a housing 120 for accommodating the water supplied thereto. Accordingly, referring to FIGS. 4 to 6, the housing 120 will be described.

The housing 120 may consist of a base and sidewalls. The base and sidewalls may define an inner space of the housing 120. In other words, the base forms a bottom surface of the housing 120 and the sidewalls may form lateral surfaces of the housing 120. A top of the housing 120 is open and the housing 120 accommodates the supplied water. The term of "accommodation" means a state without flowing. In other words, the water supplied to the housing 120 is closed in the housing 120, not exhausted via a drain unit 120.

The housing 120 may be formed in a rectangular shape. In other words, the housing 120 may be configured of rectangular base 120*e* and sidewalls. The housing 120 is rectangular-shaped and a longitudinal length is larger than a traverse length of the housing 120. Longitudinal sidewalls 120*a* and 120*b* and traverse sidewalls 120*c* and 120*d* may be upwardly extended from the base 120*e*. Accordingly, the base 120*e* and the sidewalls 120*a*, 120*b*, 120*c* and 120*d* may form a predetermined space capable of accommodating water therein. Of course, the housing 120 may accommodate steam in an upper or entire portion thereof, as the water is heated. The housing 120 may be configured to form a space 120*f* where steam is generated. The space 120*f* may be referenced to as a heating space 120*f*.

As shown in the drawings, a heater is not provided in the heating space 120*f*, different from the conventional steam generator mentioned above. In other words, the housing 120 may be simultaneously a heating object and a heating object for heating the water accommodated therein. That is, the housing 120 may perform a function of an expanded heater such that a heating area may be remarkably increased.

For that, the housing 120 may be formed of a metal material having excellent heat conductivity, specifically, an aluminum material. That is because the metal material, specifically, the aluminum material is lighter and easier to treat than other materials, with good anti-corrosiveness. Aluminum die-casting may realize a desired shape and size easily.

Figure 4:
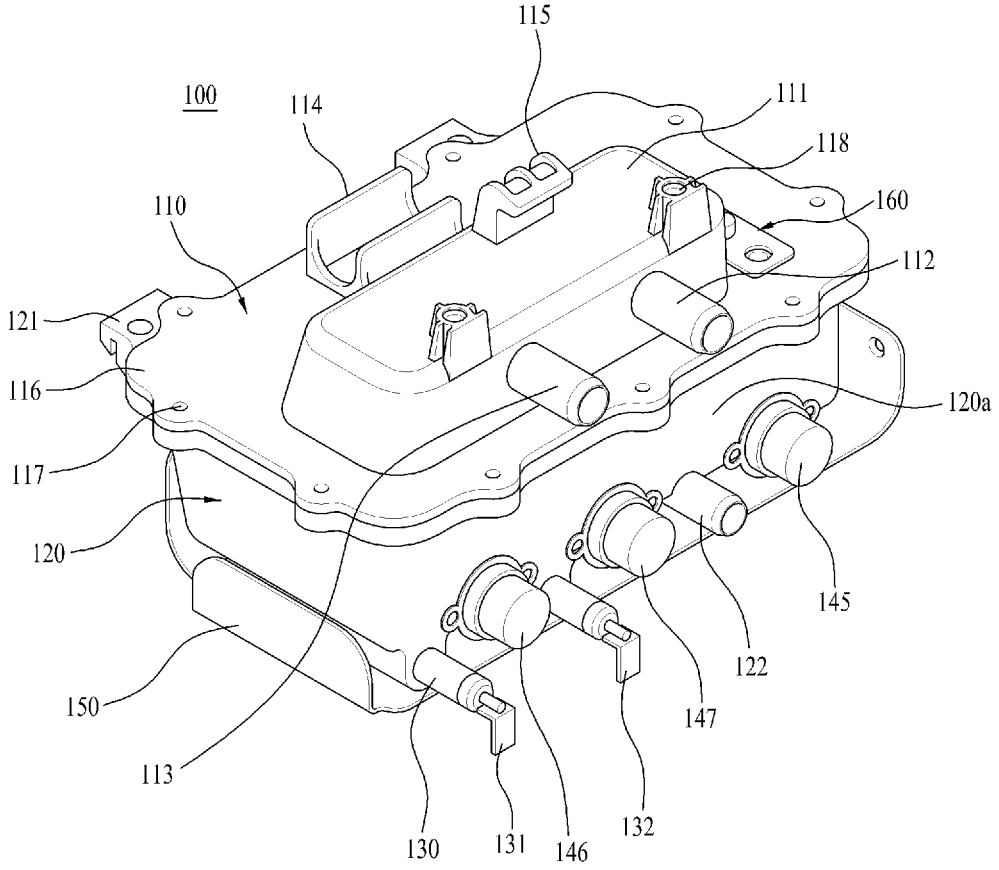
FIG. 4 is a perspective view of a steam generator according to an embodiment of the present invention.

As shown in FIG. 4, the steam generator 100 may include a cover 100. The cover 100 is configured to cover the heating space 120*f* to substantially form the closed heating-space. In other words, the cover 110 is coupled to the open top of the housing 120 to form the closed heating space 120*f*. Accordingly, the cover 110 is coupled to the top of the housing 120 to form the steam generator 100.

The cover 110 may include various components which will be described later. The shape of the cover 110 may be complex and the cover 110 may be connected to a tube, a pipe, a control or power line and various elements. Accordingly, it is preferable that the cover 110 is injection-molded of the engineering plastic, which can endure a high temperature. The engineering plastic has a poor heat conductivity, compared with the metal material and the cover 110 formed of the engineering plastic can be maintained at a lower temperature than the housing 120 formed of the metal material. Accordingly, thermal damage to the other components connected with the cover 110 may be minimized. A bracket 150 for insulation may not be provided in the cover 110, which will be described later.

Specifically, the housing 120 is formed of aluminum die-casting and the cover 110 may be formed of engineering plastic. The engineering plastic may be syndiotactic polystyrene (SPS) or polyphenylenesulfide (PPS).

Such different materials mean different coefficients of terminal expansion and means different properties transformed at an abnormally high pressure. Specifically, when the abnormal pressure is generated in the steam generator, transformation is generated one of the two and the over pressure may be relived initially because the material of the housing 120 and the material of the cover 110 are different from each other. In other words, the different transformation rates between the housing and the cover 110 may release the airtight sealing between the two components and the explosion generated by the over pressure may be prevented.

If when both of the housing 120 and the cover 110 are formed of the metal material, the abnormally overpressure could be formed. However, according to this embodiment, the housing 120 and the cover 110 are formed of different materials to generate the transformation of the cover 110. The cover 110 is transformed before the abnormally overpressure is generated and the overpressure can be relieved.

As shown in FIG. 4, the cover 110 has a plane portion, namely, a flange 116 formed in an edge area thereof for the coupling with the housing 120. A coupling hole 117 may be formed in the flange 116 for bolt or rivet fastening. The flange 116 may have an expanded portion adjacent to the coupling hole 117

Figure 6:
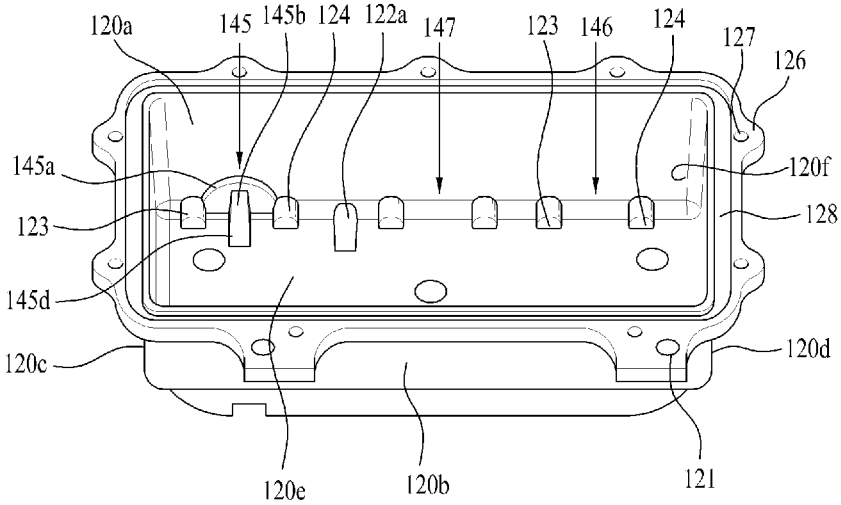
FIG. 6 is a perspective view of the housing shown in FIG. 5.

As shown in FIG. 6, the housing 120 may have a flange 126 formed in an outer portion thereof for the coupling with the cover 110. The flange 126 may be formed in upper ends of the sidewalls 120*a*, 120*b*, 120*c* and 120*d*. A coupling hole 127 may be formed in the flange 126 and a groove 128 may be formed in the flange 126. A portion of the flange 126 where the coupling holes 127 are formed may be extended from the upper ends of the sidewalls 120*a*, 120*b*, 120*c* and 120*d* outwardly with respect to the housing 120. The portion where the grooves 128 are formed may be formed in upper ends of the sidewalls 120*a*, 120*b*, 120*c* and 120*d*. The flange 126 may be integrally formed with the sidewalls 120*a*, 120*b*, 120*c* and 120*d*. A sealing member (not shown) may be seated on the groove 128.

The sealing member may be silicon and the like, and it may be provided between the housing 120 and the cover 110 to close the steam generator airtight. Meanwhile, the sealing member is employed to prevent the housing 120 from directly contacting with the cover 110, only to prevent heat conductivity generated in the housing 120 to the cover 110. In other words, the heat may be used in heating the water supplied to the housing 120 by the sealing member as much as possible.

As shown in FIG. 4, a steam concentrated portion 111 is formed in the cover 110. The steam concentrated portion 111 is projected from the top surface of the cover 110 upwardly, to form an expanded space. In other words, the steam concentrated portion 111 may be the expanded space formed above the heating space 120*f* mentioned above. Accordingly, the steam generated in the heating space 120*f* may be intensively concentrated in the steam concentrated portion 111.

The steam concentrated portion 111 may be formed in a rectangular shape and a longitudinal direction of the steam concentrated portion 111 may be in parallel with the longitudinal direction of the steam generator. An inlet 113 to draw water there through and an outlet 112 to exhaust steam there through may be provided in the steam concentrated portion 111. The outlet 112 provided in the steam concentrated portion 111 may enable only the steam to be exhausted outside. The position of the inlet 113 may be higher than the water level of the water supplied thereto and the water may be prevented from flowing backward via the inlet 113 effectively. Meanwhile, the inlet direction of the water drawn via the inlet 113 may be reverse of the outlet direction of the steam exhausted via the outlet 112. In other words, the inlet 113 and the outlet 112 may be provided in one surface of lateral surfaces of the steam concentrated portion 111. Together with that, the inlet direction of the water and the outlet direction of the steam via the inlet 113 and the outlet 113 may be perpendicular to gravity. Accordingly, the water supplied via the inlet 113 may be drawn into the steam generator and dropped by gravity simultaneously. The generated steam is lifted in the reverse direction of gravity to be exhausted to a lateral surface of the steam generator via the outlet 112.

Meanwhile, a hook structure 115, a coupling boss 118, a tube fixing structure 114 and so on may be formed in the cover 110 variously. Such structures may be configured to fix the steam generator in a cabinet provided in each of various home appliances. Also, such a hook structure 121 may be formed even in the housing 120.

As mentioned above, the temperature of the cover 110 is substantially lower than that of the housing 120. Accordingly, it is preferable that such structures configured to fix the steam generator to various home appliances are formed in the cover if possible.

A temperature sensor 160 may be provided on the cover 110, fixedly inserted in the housing 120. The structure of the temperature sensor 160 may be identical to that of the conventional temperature sensor 42 shown in FIG. 3. In other words, the ambient temperature in the housing 120 or the temperature of the water may be sensed by the temperature sensor 160. However, a controlling method of the steam generator using the temperature sensor 160 may be different from the conventional controlling method of the conventional steam generator. The controlling method according to the present invention will be described as follows.

Referring to FIGS. 4 to 7, the heater 130 will be described in detail.

Figure 7:
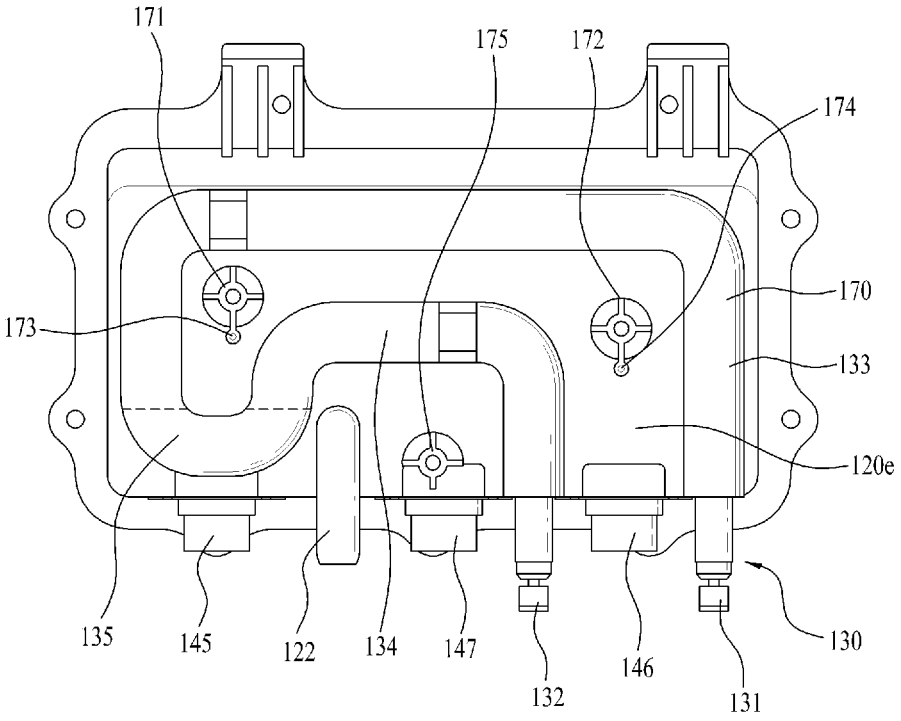
FIG. 7 is a rear view of the housing shown in FIG. 4.

First of all, referring to FIG. 7, the heater 130 includes heater terminals 131 and 132 and a heating line provided between the heater terminals 131 and 132. In other words, the heating line may heat the housing 120 by emitting heat and the heater terminals may be provided in both ends of the heating line. The heater 130 may be provided in the base 120*e*. However, as shown in FIG. 6, the heater 130 may be provided in an inner surface of the base 120*e*, without being exposed. Accordingly, the heater 130 is not exposed to the heating space 120*f* and the heater 130 is not in direct contact with the water.

Figure 3:
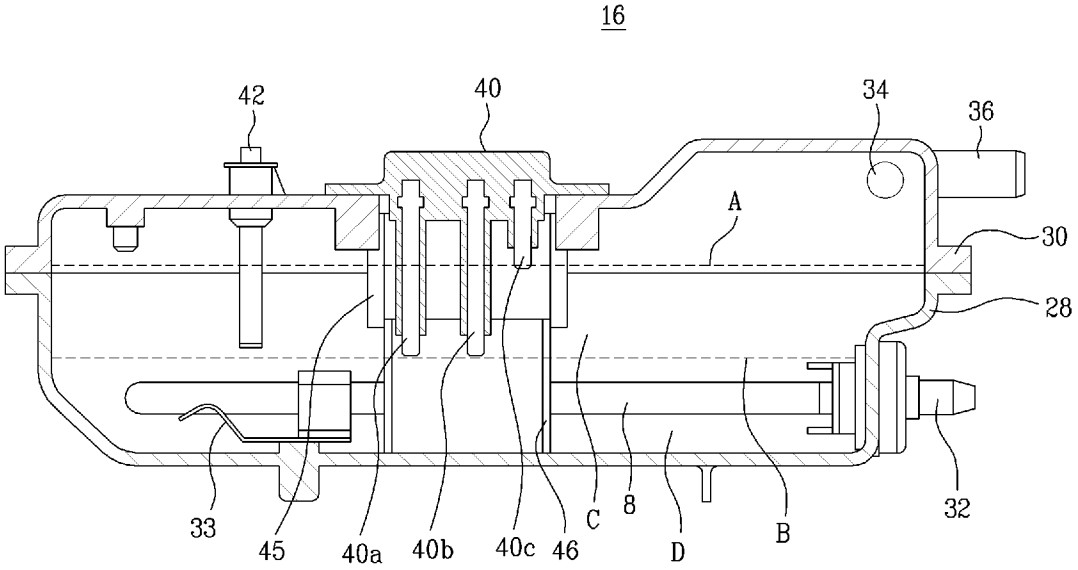
FIG. 3 is a cut-away perspective view of the steam generator, seen from a different angle.

Referring to FIG. 3, the conventional heater 32 is directly exposed to the water. The conventional heater 32 is formed of stainless in consideration of corrosion and it has the problem of high production cost. In contrast, the heater 130 according to this embodiment is not directly exposed to the water and the heater 130 may be fabricated of an iron or copper alloy that is relatively less expensive.

The heater 130 may be embedded in the housing 120. It is preferable that the heater 130 is embedded in the base 120*e* of the housing 120. In other words, the heater 130 is embedded between the upper surface and the lower surface of the housing 120. In this instance, a most portion of the heater 130 may be embedded in the base 120*e* completely, except the heater terminals for power connection to transmit the heat generated by the heater 130 to the housing 120 as much as possible, to enhance heat efficiency accordingly.

Specifically, the heater 130 may be embedded in a thick portion of the longitudinal lateral surface of the base 120*e*. In other words, the heater terminals 131 and 132 may be provided in the same surface of the base 120*e*. The embedding may be realized by die-casting. In other words, the heater is inserted in a mold and aluminum die-casting is performed to form the housing 120. Accordingly, the heater 130 is embedded in the housing 120 very firmly and a gap formed between the housing 120 and the heater 130 may be minimized, such that the emitted heat may be transmitted to the housing 120 very efficiently.

Also, such the embedding structure requires not auxiliary sealing structure for installing the heater 130 and the structure of the heater may be quite simple accordingly. In addition, no auxiliary heater fixing structure is required.

Meanwhile, as shown in FIGS. 4 and 7, a heater corresponding portion 170 may be projected downward from the housing 130, corresponding to the shape of the heater 130. The heater corresponding portion 170 may be projected downward from the lower surface of the base 120*e* and the thickness of the base 120*e* may be reduced to be lighter and to enable most of the generated heat conducted to the inner surface of the housing 120. In other words, the heat loss generated by the thickness of the base may be reduced as much as possible.

It is preferred that the surface of the heater 130 in contact with the base 120*e* is increased as much as possible to enable the heat transmission performed effectively. For that, the heater 130 may be formed in a following method. That is, the method of forming the heating line will be described as follows.

The heater 130 may include the heater terminals 131 and 132 provided outer to the housing 120 to be connected with a power supply. In this instance, the electric power may be a common power source and the common power source may be varied according to a local area, for example, 110V, 120V, 220V and the like. Accordingly, the capacity of the heater may be determined based on the type of the common power source.

Figure 5:
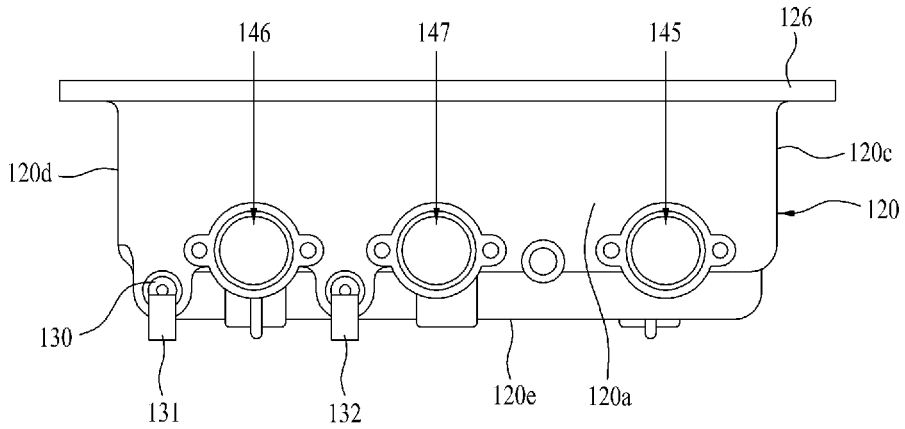
FIG. 5 is a longitudinal side view of a housing shown in FIG. 4.

Referring to FIG. 5, the heater terminals 131 and 132 may have an outer heater terminal 131 provided close to sidewall 120*d* of traverse direction sidewalls composing the housing 120. The heater terminal includes an inner heater terminal 132 adjacent to the outer heater terminal 131.

The inner heater terminal 132 may be closer to the sidewall 120*d* than the other traverse direction sidewall 120*c* accordingly, it is preferred that the outer heater terminal 131 and the inner heater terminal 132 are aside with respect to a center of the longitudinal direction sidewall of the base 120*e*. In other words, seen from a side view, the sidewall 120*d*, the outer heater terminal 131 and the inner heater terminal 132 are arranged sequentially. The two heater terminals 131 and 132 are positioned between the sidewall 120*d* and the center of the base 120*e*, such that the distance between the heater terminals 131 and 132 may be reduced to case the common power supply connection, Referring to FIG. 7, the heater 130 includes heating lines 133, 134 and 135 for connecting the outer heater terminal 131 to the inner heater terminal 132. In other words, the heating lines may form one heating line. The heating line may be in parallel with the upper surface of the base 120*e*. Also, the heating line may have a predetermined portion that is bent at least one time.

Specifically, the heating line includes an outer heater 133 provided in an outer portion of three sides composing the base 120*e*, with being extended from the outer heater terminal 131. In other words, the outer heater 133 is provided in edge portions of the other sides, except the side of the base 120*e* where the heater terminals 131 and 132 are provided. In other words, the outer heater 133 is extended to a traverse direction outer portion, a longitudinal direction outer portion and a reverse traverse direction outer portion again in order. Accordingly, the outer heater 133 may be arranged in "ㄷ" shape. Also, the heating line includes the inner heater 134 provided in the outer heater 133, extended from the inner heater terminal 132. The inner heater 134 may be in parallel with the outer heater 133. Accordingly, the inner heater 134 may be arranged in a "ㄷ" shape in the inner heater 133.

The heating line includes a loop heater having the outer heater 133 and the inner heater 134 connected curvedly with each other. Accordingly, the heating line may have the shape shown in FIG. 7. The length of the heater may be increased in the plane area of the base 120*e* effectively and the heat transmission area between the heater 130 and the base 120*e* may be increased.

Meanwhile, the heater 130 is embedded by insert molding and it is integrally formed with the base 120*e*, such that a gap between the heater 130 and the base 120*e* may be minimized to enable effective heat transmission. The base 120*e* may be integrally formed with the sidewalls 120*a*, 120*b*, 120*c* and 120*d*. In other words, the base 102*e* is integrally formed with the housing 120. The entire portion of the housing 120 is expanded as the heater. Accordingly, the area where heat is transmitted to the water may be enlarged effectively.

Figure 11:
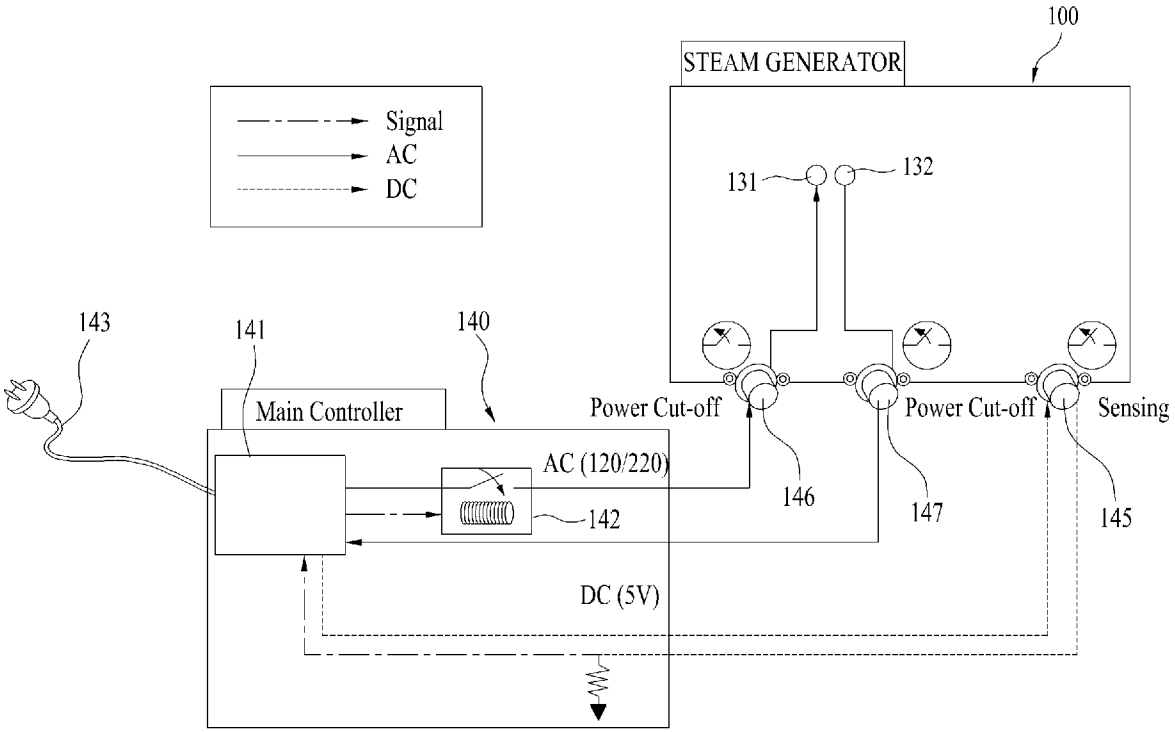
FIG. 11 is a diagram schematically illustrating a control unit according to one embodiment of the present invention.

Referring to FIG. 11, the control unit 140 will be described in detail as follows. The control unit 140 may perform a function of applying or shut off the electric power 143 to or from the heater 130. In this instance, the electric power may be a common electric voltage and the common electric voltage may be Ac 120 W or AC 220V, for example.

Specifically, the control unit 140 may be configured to cut off the power of the heater, when the temperature of the housing 120 is a first preset temperature that passes a boiling point of water. The housing 120 is employed as the heater. Accordingly, when water remains in the housing 120, there is limitation on increasing of the temperature inside the housing 120 when the temperature of the housing 120 is a first preset temperature that is higher than the boiling point of water, for example, over 100° C. at an atmospheric pressure, it can be determined that all of the water inside the housing 120 is changed into steam. In other words, it can be said that all of the supplied water is substantially converted into steam.

In this instance, the control unit 140 may control the electric power to be applied to the heater 130 until all of the water accommodated in the housing 120 is substantially converted into steam. Accordingly, all of the water inside the housing 120 is converted into steam and the water that remains under the end of the conventional low water level sensor just to be heated may be minimized or energy waste generated by the water may be minimized. The water remaining in the housing 120 to protect the heater can be removed and the time taken to generate steam may be shortened remarkably. Also, the structure of the water level sensor for sensing the heater protection water level may be omitted economically.

The control unit 140 may cut off or apply the power of the heater 130 based on the temperature of the housing 120. The control unit 140 may include a control signal generator 145 for generating a heater power control signal based on the temperature of the housing 120 and a heater controller for cut off or apply the power of the heater 130 based on the control signal. The heater power control signal may be a heater power applying signal for applying the power supplied to the heater or a heater power cut off signal for cutting off the power supplied to the heater.

The control signal generator 145 generates the heater power cut off signal when the temperature of the housing 120 reaches a first preset temperature. The control signal generator 145 may be provided adjacent to a side of the housing 120. Also, the control signal generator 145 may generate the heater power applying signal when the temperature of the housing is lowered by the cutting off of the heater 130 based on the heater power cut off signal. Specifically, the control signal generator 145 generates the heater power applying signal when the temperature of the housing 120 is lowered from a first preset temperature to a second preset temperature. In other words, the control signal generator 145 generates the heater power cut off signal when the temperature of the housing 120 reaches the first preset temperature and it generates the heater power applying signal when the temperature of the housing 120 reaches the second preset temperature after lowered from the first preset temperature. At this time, it is preferred that the second preset temperature is over the boiling point of water and that it is lower than the first preset temperature.

Meanwhile, it is preferable that the control signal generator 145 is a thermostat. The connection of the thermostat 145 may be cut off according to characteristics of the thermostat 145 when the temperature thereof reaches a preset temperature. In other words, the thermostat 145 spontaneously reacts with the preset temperature and it can reduce a reaction deviation. The present invention proposes that the control signal generator be a thermostat. The same numeral reference of 145 is given to the control signal generator and the thermostat for explanation sake.

The function of the thermostat 145 will be described in detail as follows.

When the heater starts the heating after the power is applied to the heater 130, the water is heated to be converted into steam. If there is remaining water, the temperature increase of the housing 120 is limited. However, when all of the water is converted into steam, the temperature of the housing 120 is heightened continuously. Accordingly, when the temperature of the housing 120 reaches the first preset temperature that is over the boiling point of water, it is surely that all of the water within the housing 120 is converted into steam. In this instance, it is preferred that the power of the heater 130 is controlled to be cut off. Accordingly, the thermostat 145 generates the heater power cut off signal when the temperature of the housing 120 is the first preset temperature and the heater controller cuts off the power of the heater 130 based on the heater power cut off signal.

When the power of the heater 130 is cut off, the temperature of the housing 120 will be gradually lowered. It is preferred that the thermostat 145 is re-connected to apply the power to the heater. In other words, when the temperature of the housing 130 is lowered to the second preset temperature from the first preset temperature, the thermostat 145 generates the heater power applying signal and the heater controller re-applies the power of the heater based on the heater power applying signal. After that, when continuous steam generation is required, water may be supplied to the housing. In other words, when a steam cycle is not completed, water supply may be performed. Meanwhile, when the steam cycle is completed, the heater controller may not apply the power to the heater even when the thermostat 145 generates the heater power applying signal. In other words, even when the power of the heater is cut off by the finish of the steam cycle or the temperature of the housing 120 is lowered to the second preset temperature from the first preset temperature after water supply is performed after the finish of the steam cycle, the heater controller may not re-apply the power of the heater. In other words, the heater power applying signal generated by the thermostat 145 is valid during the steam cycle.

In this instance, the second preset temperature may be higher than the boiling point of water, because the remaining heat of the housing can be reused in generating steam after the heater power cut-off. That is, the time taken to re-generate steam can be reduced effectively.

Specifically, the first preset temperature may be set between 115° C. and 125° C. The reaching of the first preset temperature enables the heat to be transmitted to the heater 130, the housing 120 and the water accommodated in the housing 120 sequentially. The water is boiled approximately at 100° C. and it is guaranteed that all of the water is converted into steam.

When the power of the heater is cut off and water is supplied, the temperature of the housing is lowered drastically. In this instance, it is quite important to determine the point of re-applying the power to the heater. That is because the time taken to perform the overall steam cycle is increased as the time taken to re-apply the power to the heater after cutting off the power of the heater is increased. Also, the time taken to emit the remaining heat within the housing outside the steam generator is increased.

Accordingly, it is preferred that the second preset temperature is higher than the boiling point of water, with being lower than the first preset temperature, specifically, between 105° C. and 115° C. The power can be applied to the heater 130 right after the water supply starts and rapid steam generation may be enabled.

In other words, the thermostat 145 may replace the water level sensor and the design for remaining water or the heater protection water level does not have to be considered. Also, the housing itself performs the function of the heater and the power density of the heater 130 may be enhanced, such that it may be possible to provide a compact-sized steam generator that enables the rapid steam supply due to the increase of heat efficiency.

As shown in FIG. 11, the control signal generator 145 is employed as a sensor for sensing the water supplied to the housing 120. When the control signal generator 145 is the thermostat, the sensor function is performed by the connection and cut-off of the thermostat. It is preferred that a switch function for directly cut off the power of the heater 130 is not performed and a control power may be connected to the thermostat 145, specifically, DC5V.

In this instance, the thermostat 145 generates different control signals when connected or disconnected to or from the control power. In other words, when connected to the control power, it means that water remains in the housing that the thermostat generates the power applying signal of the heater. When disconnected from the control power, it means there is no water in the housing and the thermostat generates the power cut off signal of the heater.

Such the control signal is transmitted to the heater controller. The heater controller cuts off or applies the power of the heater 130 based on the control signal of the control signal generator 145. In other words, the heater controller applies the power supplied to the heater 130 when the control signal generator 145 generates the heater power applying signal, and it cuts off the power supplied to the heater 130 when the control signal generator 145 generates the heater power cut off signal. Together with that, the heater controller controls water to be supplied to the housing based on the heater power cut off signal.

The heater controller includes a controller 141 that controls the power of the heater 130 after receiving the control signal. The controller 141 cuts off or apply the power of the heater 130, specifically, the common power voltage based on the power cut off signal or the power applying signal of the heater.

Meanwhile, the controller 141 determines that there is no water within the housing 130 based on the power cut off signal of the heater. Accordingly, the controller 141 controls water to be supplied to the housing 120 based on the power cut off signal of the heater 130. In other words, the controller 141 controls a water supply valve or a water supply pump to control the water to be supplied to the housing. At this time, the controller 141 cuts off the power supplied to the heater 130 and it controls the water supply to the housing 120 to be performed simultaneously.

In this instance, the controller 141 controls the water supply based on the water supply time, because the water level sensor can be omitted in this embodiment. Detailed description of the water supply control will be described later.

The heater controller includes a heater switch 142 for selectively applying the common power voltage to the heater 130. The controller 141 controls the heater switch 142 based on the control signal of the control signal generator 145. It is preferred that the heater switch 142 is provided on a power supply line where the power is supplied to the heater 130. Together with that, it is preferred that the controller 141 is provided on the power line for supplying the power to the heater 130. At this time, the controller 141 and the heater switch 142 may be connected with each other serially. The heater switch 141 may be serially connected between the controller 141 and the heater 130. The heater switch 142 may be connected with the heater serially. Accordingly, when the switch is switched on, the power is applied to the heater. When the switch is switched off, the power is cut off from the heater. Such the heater switch 142 may be a relay switch, for example. The heater switch 142 may be selectively controlled by the control signal of the controller 141.

The controller 141 controls the heater switch 142 to generate steam when the steam cycle starts to operate and to stop the steam generation when the steam cycle finishes. In this instance, the steam cycle means the process of generating and supplying steam to the object accommodation part. Accordingly, when the steam cycle starts to operate, the controller 141 basically controls the heater switch 142 to be on to start the heating and controls the heater switch 142 to be off to finish the heating when the steam cycle finishes.

The controller controls the heater switch to be on when the steam cycle starts. After that, the controller controls the heater switch 142 based on the power cut off signal and the power applying signal of the heater until the steam cycle finishes. The steam cycle and the heater control performed during the steam cycle will be described in detail later.

The control signal generator 145 mentioned above may be used as means for sensing whether there is water within the housing 120. In addition, the control unit 140 may further include an overheat preventer 146 and 147 for preventing overheat of the heater 130. The overheat preventers may be provided in the housing and they cuts off the power supplied to the heater, when the temperature of the housing reaches a third preset temperature that is the first preset temperature or higher. The overheat preventer 146 and 147 cuts off the power connected to the heater 130, regardless of the control signal of the controller 141, when the temperature of the housing 120 is a predetermined temperature or more. The overheat preventer 146 and 147 is configured to prevent overheat of the heater 130 and it is preferred that the overheat preventer 146 and 147 are provided on the line of the power supplied to the heater 130 and that they are connected with the heater switch 142 serially. The overheat preventer 146 and 147 may be connected between the controller 141 and the heater 130 in serial. The overheat preventers may be configured to cut off the power of the heater 130 at a third preset temperature that is higher than the first preset temperature. Accordingly, when the temperature of the housing 120 reaches the third preset temperature, the overheat preventer 146 and 147 cuts off the power of the heater 130, regardless of the control of the controller 141. At this time, the overheat preventer 146 and 147 may be a thermostat.

The overheat preventer 146 and 147 may be configured to directly cut off or apply the power of the heater based on the temperature of the housing 120. Accordingly, at least two overheat preventers may be provided to prevent the overheating of the heater 130 more stably. When two overheat preventers are provided, one of the overheat preventers may be a first overheat preventer 146 connected with the outer heater terminal 131 in serial and the other one may be a second overheat preventer 147 connected with the inner heater terminal 132 in serial. The first overheat preventer 146 may be serially provided between the heater switch 142 and the heater 130. The second overheat preventer 147 may be serially provided between the controller 141 and the heater 130.

For the overheat prevention function, the third preset temperatures of the first overheat preventer 146 and the second overheat preventer 147 may be set different. One of the overheat preventers may be a reversible type to which the power is re-applied as the temperature is getting lowered after the power is cut off and the other may be a non-reversible type to which no power is re-applied even when the temperature is getting lowered after power cut off. In the latter one, the power may be re-applied after a reset button is pushed.

Meanwhile, the control signal generator and the overheat preventers 145, 146 and 147 have a common characteristic of directly reacting with the temperature of the housing, different in the water sensing and the overheat prevention. A closer portion to the heater 130 in the housing 120 has a high temperature. The installation positions and structures of such components are quite important.

Meanwhile, in FIG. 11, the controller 141 and the overheat preventers 146 and 147 are serially connected to the power line connected with the heater. The control signal generator 145 may be serially connected to the controller 141 on the power line connected to the heater. In other words, the control signal generator 145 may be serially provided between the controller 141 and the heater terminals 131 and 132. Even in this instance, the control signal generator 145 may be a thermostat. At this time, when the temperature of the housing 120 reaches the first preset temperature, the control signal generator 145 cuts off the power connected to the heater 130. When the temperature of the housing 120 is lowered to the second preset temperature from the first preset temperature, the control signal generator 145 re-connect the power to the heater.

Meanwhile, the controller 140 may be control water to be supplied to the housing 130 according to the temperature of the housing 120. At this time, the water supply may be performed for a predetermined time period. Specifically, the control unit 140 may control water supplied to the housing, when the control signal generator 145 generates a first signal. The first signal is generated when the temperature of the housing 120 reaches the first preset temperature that is over the boiling point of water. In other words, the control unit 140 may controls water to be supplied to the housing 120, when the temperature of the housing 120 reaches the first preset temperature that is over the boiling point of water. The control unit 140 may control the water supply valve to control the water supply to the housing 120 to be performed. Together with that, when the first signal is generated, the control unit 140 may cut off the power of the heater 130. In other words, when the temperature of the housing 120 reaches the first preset temperature that is over the boiling point of water (the first signal is generated), the control unit 140 selectively controls water to be supplied to the housing 120 or the power of the heater 130 to be cut off. As mentioned above, the control unit may simultaneously control the water to be supplied to the housing 120 and the power of the heater 130 to be cut off. When the first signal is generated, the temperature of the housing 120 may be lowered under a first preset temperature by the water supply to the housing 120 that is performed for a predetermined time period without cutting off the power of the heater 130. At this time, the power of the heater is still applied and the supplied water is heated to be converted into steam as the time passes. The temperature of the housing 120 may reach the first preset temperature again. At this time, the first signal is re-generated by the control signal generator 145 and the control unit 140 controls water to be supplied to the housing 120. The steam cycle may be performed by such a repeated process. The control signal generator 145 may be a thermostat provided in the housing 120.

Referring to FIGS. 4 to 7, the installation positions and structures of the control signal generator and the overheat preventers will be described in detail.

First of all, the installation position structure of the control signal generator 145 will be described.

Basically, the inner surface of the housing base 120*e* may substantially form a horizontal plane and a surface of the water accommodated in the housing may form a horizontal plane, in parallel with the inner surface. Accordingly, the position at which it is identified that all of the water is converted into steam may be a corner where the inner surface of the base 120*e* meets an inner surface of one sidewall and it is preferred that the control signal generator 145 is positioned to sense the temperature of such a corner.

Meanwhile, when the control signal generator is the thermostat 145, a control power is applied. Accordingly, the thermostat 145 is installed to an outer surface of the sidewall of the housing 120 or an outer surface of the base. For that, a boss 123 and 124 may be extended into the housing. The boss 123 and 124 may have a coupling hole formed from an outside of the housing. Such bosses are formed in both sides of the housing 120 to couple and fix the thermostat thereto from the outer surface of the housing.

The steam generator 100 may be formed in a rectangular shape as mentioned above. The steam generator is installed in an electric home appliance. When the steam generator is installed in the electric home appliance, there might be a horizontal error. Also, when the electric home appliance is installed, there might be a horizontal error. That means that the inner surface of the base is not a horizontally plane. If it is not the horizontally plane, a difference between the heights of longitudinal ends would be larger than a difference between the heights of traverse ends. Considering that, the water sensing thermostat 145 may be provided in a longitudinal sidewall as shown in FIG. 7, specifically, adjacent to the loop heater 135. Accordingly, the water sensing thermostat 145 is provided adjacent to the heater 130 and it is possible to enhance temperature reactivity. In other words, it is preferred that the water sensing thermostat 145 is positioned closest to the heating line of the heater. According to this embodiment, a heater terminal, a control signal generator, an overheat preventer may be provided in one sidewall of the steam generator. Also, the heating line is configured of an inner heater, an outer heater and a loop heater. In this instance, the loop heater may occupy the closest position to the heating line of the heater.

In addition, a projection structure projected to the inside of the housing 120 may be formed in the housing 120 where the thermostat 145 is installed. Accordingly, heat reaction may be acquired faster by the vaporization of water in such the structure than in the other positions. In other words, the temperature reactivity may be enhanced more. Specifically, referring to FIG. 6, a compensating protrusion 145*b* and/or a projection 145*a* may be formed at the portion where the thermostat 145 is positioned. The compensating protrusion 145*b* is formed at the corner where the thermostat 145 is positioned. In other words, the compensating protrusion 145*b* is formed between the sidewall 120*a* and the base 120*e* of the housing 120. The compensating protrusion 145*b* is projected from an inner lateral surface of the housing 120, specifically, from the sidewall 120*a* and the base 120*e*. Seen from the side, the compensating protrusion 145*b* has a right triangle shape. Also, the projection 145*a* may be projected toward the inside of the housing 120 to sense the temperature inside the housing 120. The projection 145*a* is projected from an inner surface of the sidewall 120*a* of the housing and it may be formed in a hemispheric shape. In this instance, the compensating protrusion 145*b* may perform a function of enlarging a surface area corresponding to the thermostat 145. Also, the projection 145*a* may perform a function of enlarging a surface area corresponding to the thermostat 145. Specifically, when the water is gradually getting decreased, the projection 145*a* enlarges an area not in contact with the water more than the other area, to perform the function of enhancing the temperature reactivity.

The compensating protrusion 145*b* may be provided to reduce an error of the water sensing that might be generated by the horizontal error effectively. In other words, when a little amount of the water remains, a large temperature difference at the base might be generated by the horizontal error.

For example, when the left height is larger than the right height, there is no water in the left side and water only in the right. The compensating protrusion 145*b* may enable the temperature therein to increase rapidly, compared with the other opposite portion. Accordingly, the compensating protrusion 145*b* compensates the horizontal error to determine no water rapidly.

In contrast, when the right height is larger than the left height, there is no water in the right and some water only in the left. Similar to what is mentioned before, the compensating protrusion 145*b* senses the temperature of a high position and the high portion is prevented from increasing slowly, compared with the other opposite portion. Accordingly, the compensating protrusion 145*b* compensates the horizontal error to determine no water rapidly.

In other words, the compensating protrusion 145*b* may reduce the temperature difference when there is no water because of the horizontal error, to perform the water sensing effectively.

Also, the compensating protrusion 145*b* or the projection 145*a* may be positioned higher than the inner surface of the base 120*e*. Considering that scale accumulates from the bottom, the temperature sensing error that might be generated by the scale may be effectively reduced by the compensating protrusion 145*b* or the projection 145*a*.

Meanwhile, the thermostats 146 and 147 configured as the overheat preventers are provided in consideration of safety and they may be installed at positions representing an overall temperature of the steam generator. Accordingly, the thermostats 146 and 147 may be provided between heating lines, not on the heating lines such as the thermostat 145. The thermostats 146 and 147 may be provided at a position apart from the heating lines by a predetermined space. In other words, as shown in FIG. 7, one of the thermostats may be provided between the outer heater terminal 131 and the inner heater terminal 132. Also, the other one may be provided in a center portion. Those thermostats may be installed in the outer surface of the steam generator via the bosses 123 and 124.

A recession 122*a* recessed downward is formed in the inner surface of the base 120*b* to communicate with the outside of the housing. The recess 122*a* is in communication with a drain 122 to drain the water.

The drain 122 may be configured to drain the water inside the housing outside after the product testing. In this instance, when the steam generator is on sale as an actual product, the drain is blocked.

As shown in FIG. 4, three thermostats may be sequentially in one longitudinal sidewall 120*a* of the housing 120. An inlet 113, an outlet 112 and the drain 122 may be formed in the same sidewall 120*a*. Also, the terminals 131 and 132 of the heater may be formed in the same sidewall 120*a*. Accordingly, connection of a tube, a pipe, an electric wire or a control wire is performed in one sidewall. The steam generator may be fabricated easily and compactly. That is to enable a bracket, which will be described later, to cover those parts of the housing 130.

Figure 8:
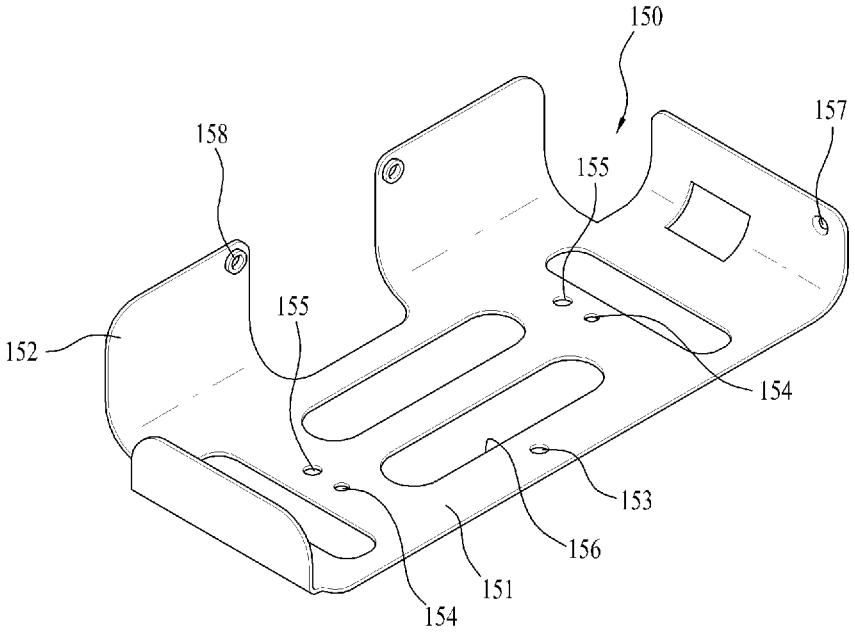
FIG. 8 is a perspective view of a bracket shown in FIG. 4.
Figure 9:
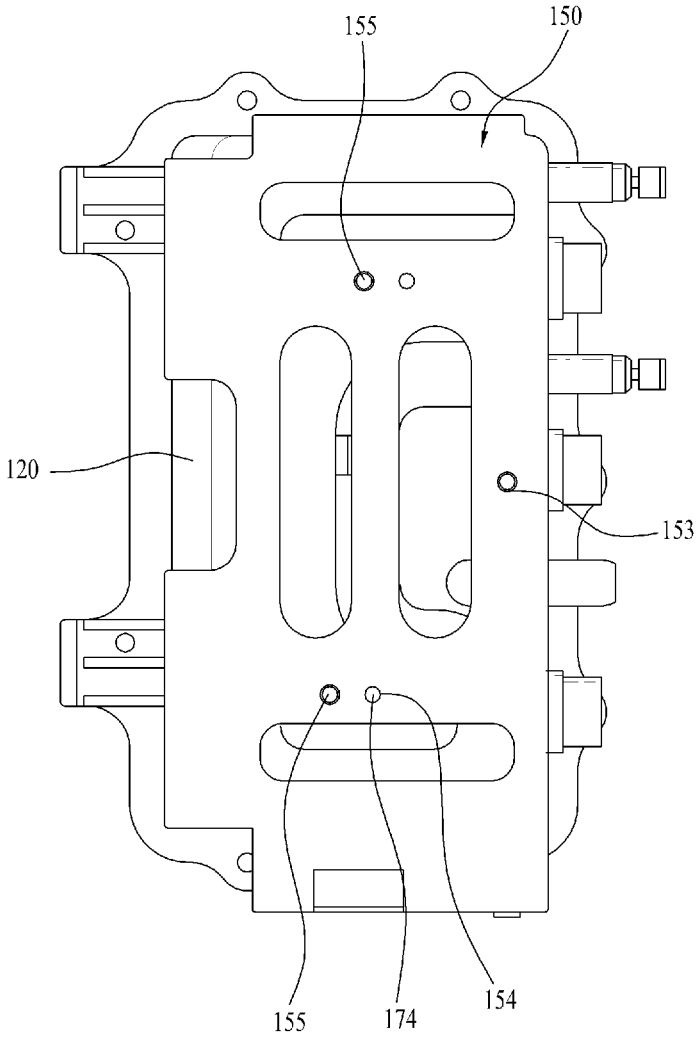
FIG. 9 is a rear view of the steam generator shown in FIG. 1.
Figure 10:
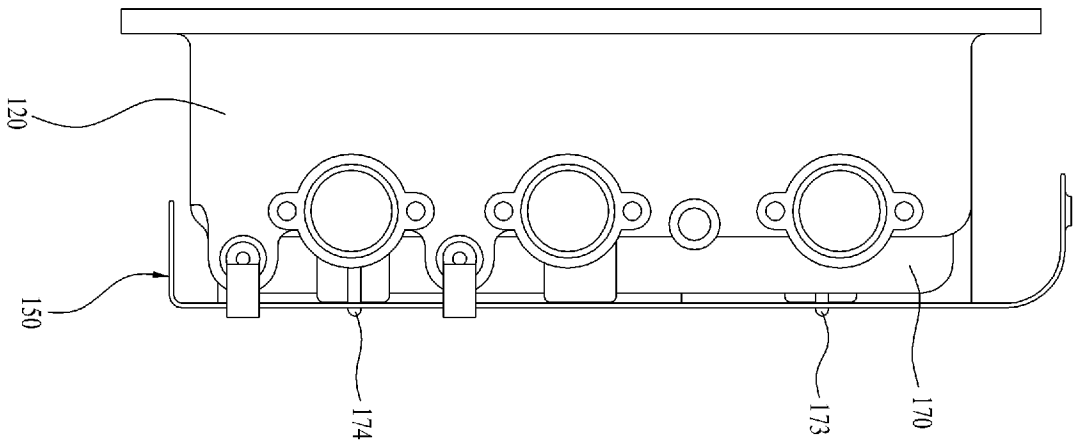
FIG. 10 is a side view of the steam generator shown in FIG. 4.

Referring to FIGS. 8 to 10, the bracket 150 will be described in detail as follows.

As mentioned above, the entire portion of the housing 120 according to the embodiment can be one heater. The housing 120 may be formed of aluminum having good heat conductivity and the temperature of the housing 120 may be quite high. Accordingly, it is preferred that the heat of the housing is prevented from being transferred to other components positioned outside the housing. For that, a bracket 150 shown in FIG. 8 may be further provided.

The bracket 150 may be formed to surround the base and sidewalls of the housing, and an air layer is formed between the bracket and the housing. Such an air layer is relatively narrow and heat transfer may be minimized. In other words, air convection may minimize the heat transfer and heat loss may be minimized accordingly. In addition, the air layer may reduce the loss of the heat transmitted to the outside of the bracket.

As described above, the components of the steam generator connected outside are intensively provided in the specific portion of the housing, in other words, the specific sidewall 120*a*. The bracket may not surround the sidewall 120*a*, to prevent the heat of the housing from being transferred outside as much as possible.

Specifically, the bracket 150 includes a bracket base 151 corresponding to the base of the housing and bracket sidewalls 152 corresponding to the sidewalls of the housing. At this time, the bracket sidewalls 152 are spaced apart a predetermined distance from the sidewalls of the housing. As mentioned above, no sidewall is provided in one side to allow the various components connected to the steam generator. The connections may be intensively provided in the sidewall.

Meanwhile, an opening 156 may be formed in the bracket base 151 to prevent the bracket from overheating.

As mentioned above, the temperature of the housing 120 composing the steam generator is higher than the temperature of the cover 110. Accordingly, it is not preferred that the housing 120 is directly fixed to the electric home appliance. Predetermined configurations may be formed in the cover 110 to fix the steam generator. Independently from that, various configurations may be formed in the bracket 150 to fix the steam generator to the electric home appliance.

Specifically, various coupling portions 157 and 158 may be formed in the bracket sidewall 152, because the temperature of the bracket is lower than that of the housing 120. As mentioned above, the bracket 150 may form the air layer with the housing 120.

The heat transfer enabled by air convection is strong, compared with heat transfer enabled by conductivity. The bracket 150 has to be coupled to the housing 120. Based on that, it is preferred that the coupling area between the bracket 150 and the housing 120 is decreased as much as possible.

For the coupling between them, bosses 171, 172 and 175 may be formed in the base 120*e* of the housing 120. The bosses 171, 172 and 175 may be projected more downward than the heater corresponding portion 170. Accordingly, the bracket base 151 and the base 120*e* of the housing 120 may be spaced apart a predetermined distance from each other by the bosses 171, 172 and 175. The bosses 171, 172 and 175 may be provided at positions out of the heating line. In other words, the bosses 171 and 172 may be provided in both opposite side portions between the outer heater 133 and the inner heater 134, respectively. The other boss 175 may be further provided in the position between the bosses 171 and 182, out of the heating line.

Position determining protrusions 173 and 174 may be provided adjacent to two of more of the bosses 171, 172 and 175.

Corresponding configurations to the bosses and the protrusions may be formed in the bracket 150. Specifically, coupling holes 153 and 155 corresponding to the bosses 171, 172 and 175 may be formed in the bracket. Also, a position fixing hole 154 corresponding to the protrusions 173 and 174 may be formed in the bracket.

First of all, the position determining protrusions 173 and 174 are inserted in the position fixing holes 154, respectively, to fix the position of the bracket 150 coupled to the housing. After that, the bosses and the coupling holes are coupled to each other via a screw and the like.

As mentioned above, the bosses are formed out of the heating line. The air layer is formed between the base of the housing and the bracket by the bosses and the position determining protrusions. Accordingly, the contact area between the housing and the bracket may be minimized and the bracket is coupled to the housing more easily and firmly.

Such the air layers formed between the housing and the bracket may prevent the temperature of the bracket from getting increased too high. Accordingly, the bracket 150 may enable the steam generator 100 installed in the electric home appliance fixedly.

As a result, the fixing structure of the steam generator according to this embodiment may be various by the cover 120 or the bracket 150. The steam generator according to this embodiment may be commonly installed in various electric home appliances.

Figure 12:
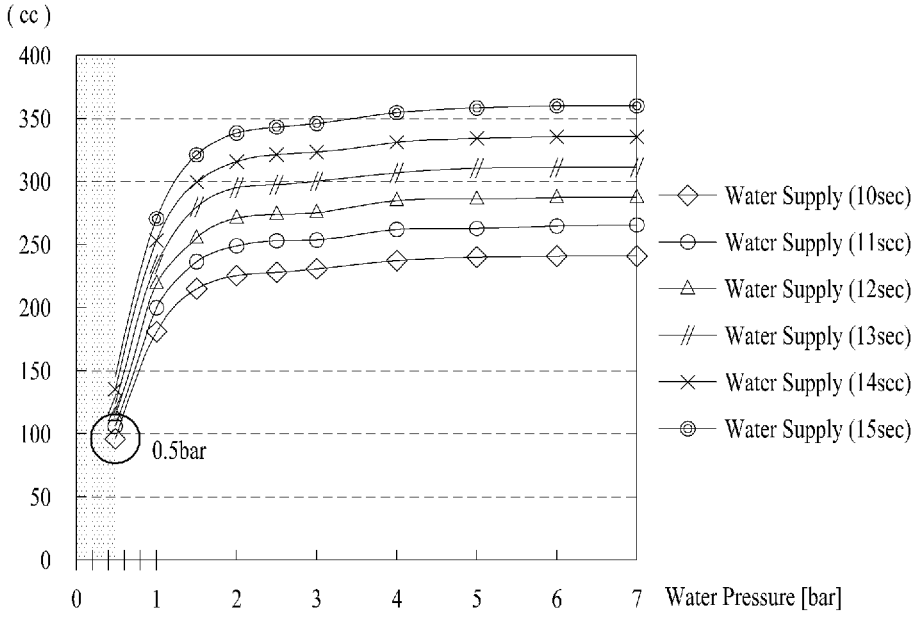
FIG. 12 is a graph illustrating a relation between the amount of water supplied to the steam generator and the pressure of water.
Figure 13:
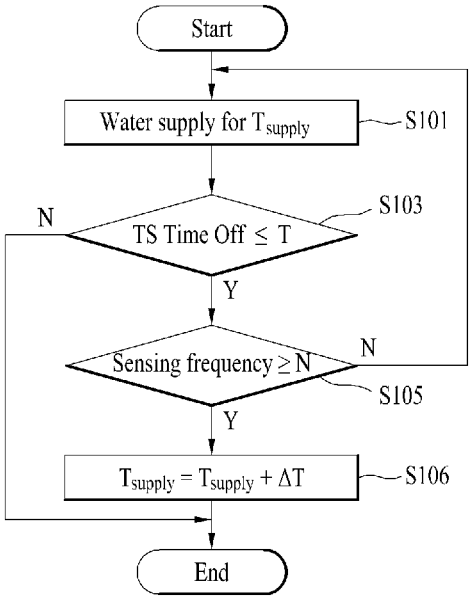
FIGS. 13 and 14 are flow charts schematically illustrating low water pressure compensation water supply control according to one embodiment of the present invention.

Referring to FIGS. 12 and 13, water supply control according to one embodiment will be described in detail.

According to this embodiment, the steam generator may be connected to an external water supply source, for example, water supply facilities. In other words, the steam generator may be configured to be supplied water via a faucet in a building. In this instance, the pressure of the supplied water may be varied according to necessity. Also, the pressure may be varied according to an actual condition of water usage in a building.

As mentioned above, the steam generator according to this embodiment may have no water level sensor and the control for the water supply may be performed based on the water supply time.

As shown in FIG. 12, when the water supply time is increased, the water supply amount may be increased naturally. However, if the pressure of the supplied water is increased to a predetermined value or more, the water supply amount may not be increased for the same water supply time. That is because an external water pressure is decreased by a water supply valve provided in an electric home appliance connected with the faucet. Also, a pipe diameter of the water supply line connected from the water supply valve to the inlet of the steam generator is relatively small and there is the pressure reduction effect enabled by the water supply line. A check valve may be provided in the water supply line to prevent the steam or water of the steam generator from flowing backward. Such a check valve may be one of the reasons generating the pressure reduction.

The water supply amount increased as the structural pressure reduction may enlarge the external water pressure is little. In contrast, the water supply amount according to the water pressure may be remarkably different because of such the pressure reduction effect, when the external water pressure is smaller than a predetermined water pressure.

As shown in FIG. 12, when the proper amount of water supply is 250 cc, the water supply is performed approximately for 12 seconds and then the proper amount of water may be supplied, regardless of the external water pressure. However, when the external water pressure is 1 bar or less, especially, 0.5 bar, the amount of the water supply is remarkably small.

As mentioned above, in the embodiment of the present invention, it is determined based on the temperature of the housing whether there is water remaining in the housing of the steam generator. Considering the capacity of the heater, a correlation between the amount of the supplied water and the time taken to generate the power cut off signal of the heater after the power is applied to the heater may be experimentally figured out.

For example, when the amount of the supplied water is relatively small, the time taken to convert all of the water into steam may be relatively short. In contrast, when the amount of the supplied water is relatively large, the time may be relatively long. Meanwhile, the amount of the steam supplied during the steam cycle may be variable based on the purpose of the steam supply. However, it is necessary to convert and supply a large amount of water into steam as the case may be.

As mentioned above, the steam generator according to the embodiment of the present invention may reduce the time taken to generate steam remarkably, even with reducing the capacity of the water accommodation portion, compared with the conventional steam generator. Accordingly, according to the embodiment of the present invention, the frequency of repeating the re-water-supply and heating may be increased when supplying a large amount of steam, compared with the frequency performed in the conventional steam generator.

As shown in FIG. 12, when the external water pressure is normal, the frequency of repeating the re-water-supply and heating is not so increased. However when the external water pressure is quite low, a much smaller amount of water than the proper amount is supplied and the frequency of repeating the re-water-supply and heating is increased too much, which might be determined as a heating error or a water supply error.

As a result, to prevent such a problem may be proposed a low water pressure compensating algorithm for compensating a low water pressure. Referring to FIG. 13, the low water pressure compensating algorithm will be described in detail as follows. The low water pressure compensating algorithm which will be described as follows may be performed during or before the steam cycle of the selected course and it is preferred that the low water pressure compensating algorithm is performed before the steam cycle starts. In other words, the low water pressure compensating algorithm may be performed before the steam cycle of the selected course starts to operate.

As shown in FIG. 13, the water supply is performed by the steam generator for a predetermined time period (Tsupply) (S101). After the power is applied to the heater of the steam generator, the sensing time taken for the control signal generator 145 to generate the heater power cut off signal (TS Off time) is counted and the counted sensing time is compared with a preset time (T1) (S103). The sensing time (TS Off time) may be the time taken for the temperature of the housing to reach a first preset temperature. In other words, the sensing time (TS Off time) means the time taken to convert all of the water supplied to the steam generator for the predetermined time (Tsupply) into steam. The preset time (T1) may be the time set based on the normal water pressure and the water supply time set based on the normal water pressure. Accordingly, when the time taken to generate the heater power cut off signal is the preset time (T1) or less, it is determined that the external water pressure is low and the water supply time is compensated (S106). In other words, the compensated time (Δ T) is added to the preset water supply time and the total water supply time is increased (S120).

Meanwhile, when the time taken to generate the heater power cut off signal is longer than the preset time (T1), it is determined the external water pressure is normal and the water supply time is not compensated.

As it will be described later, especially, the steam cycle set in a washing machine may be performed in various courses. The steam cycle may be performed during a washing cycle, during a drying cycle or before and after the drying cycle. Accordingly, the purpose of the steam cycle may be differentiated according to a selected course and a state of an object may be differentiated. The variation of such courses and the structure of the steam generator may differentiate an initial driving pattern of the steam generator according to the selected course. Also, the temperature of the steam generator, specifically, the housing may be varied according to outdoor environments. In other words, the temperature of the housing is relatively low in the winter and the temperature is relatively high in the summer. In this instance, the sensing time (TS Off time) may be varied according to the outdoor environments.

As a result, the low water pressure compensating algorithm may count the time taken to generate the heater power cut off signal after the first signal, not the heater power cut off signal for the first time. In other words, the low water pressure compensating algorithm may be performed, after the power is applied to the heater of the steam generator until the temperature of the housing is over the boiling point of water. That is because the amount of the water starts to be heated may be varied according to the course or the temperature of the steam generator may be varied according to external environments. As a result, it is preferred that the TS Off time of the low water pressure compensating algorithm may starts from the second heating, which will be described later.

Meanwhile, to compensate the water supply time (S120), a frequency of sensing the lower water pressure is counted comparing TS Off time with T1 (S105). In other words, the number of times the water supply pressure is determined as a lower water pressure are counted. When the sensing frequency is a preset value (N) or more, the water supply time may be compensated. In other words, only when the low water pressure sensing frequency is generated continuously as the water supply and the heating are repeated, it is determined that the low water pressure is sensed and the water supply time can be compensated. That is because the usage amount is temporarily increased only to lower the water pressure and because it returns to the normal water pressure.

Accordingly, when the low water pressure sensing frequency is continuously at least twice or more, the water supply time may be compensated.

Figure 14:
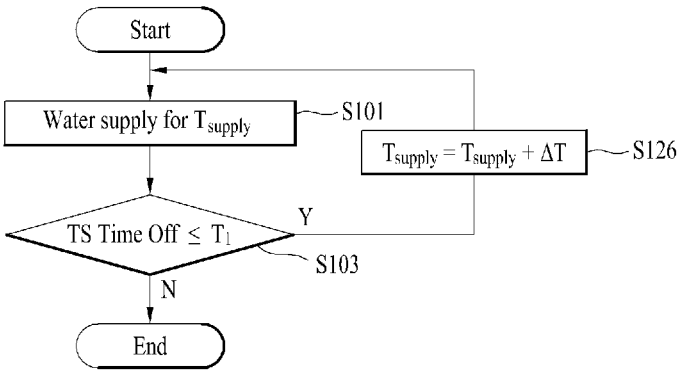

Meanwhile, the low water pressure compensating algorithm may be performed as shown in FIG. 14. FIG. 13 shows that the water supply time is compensated once finally, when the sensing frequency is a predetermined number of times. FIG. 14 shows that the water supply time is compensated whenever the low water pressure is sensed. In other words, the low water pressure compensating algorithm is re-performed according to the compensated water supply time in the water supplying compensating step. When the sensing time is a preset time period or more, the low water pressure compensating algorithm may finish.

Specifically, according to the low water pressure compensating algorithm shown in FIG. 14, the water supply to the steam generator is performed for the preset time (Tsupply) (S101). Together with that, the power is applied to the heater of the steam generator and the water supplied to the steam generator is heated. The time (TS Off time) taken for the temperature of the housing, specifically, the housing to reach a first preset temperature is counted and the counted TS Off time is compared with the preset time (T1) (S103). At this time, when the TS Off time is shorter than the preset time, a predetermined time (dT) is added to the water supply time (Tsupply) and the water supply time is compensated (S126). The water is re-supplied to the steam generator for the compensated water supply time (Tsupply) (S101). The low water pressure compensating algorithm is repeated as mentioned above and the water supply time (Tsupply) is increased as much as Δ T and the amount of the water supply is increased. As the water supply time is increased, the sensing time (TS Off time) is increased. When the increased TS Off time is the preset time (T1) or more, the water supply is performed based on the final compensated water supply time after that.

Meanwhile, an initial driving pattern of the steam generator in which the water supply and the heating stats may be differentiated according to the performed course. In other words, a driving pattern of the steam generator in an initial period of the steam cycle may be differentiated according to the performing course. However, a final period pattern of the steam cycle may be identical to the initial period pattern, regardless of the course.

Figure 15:
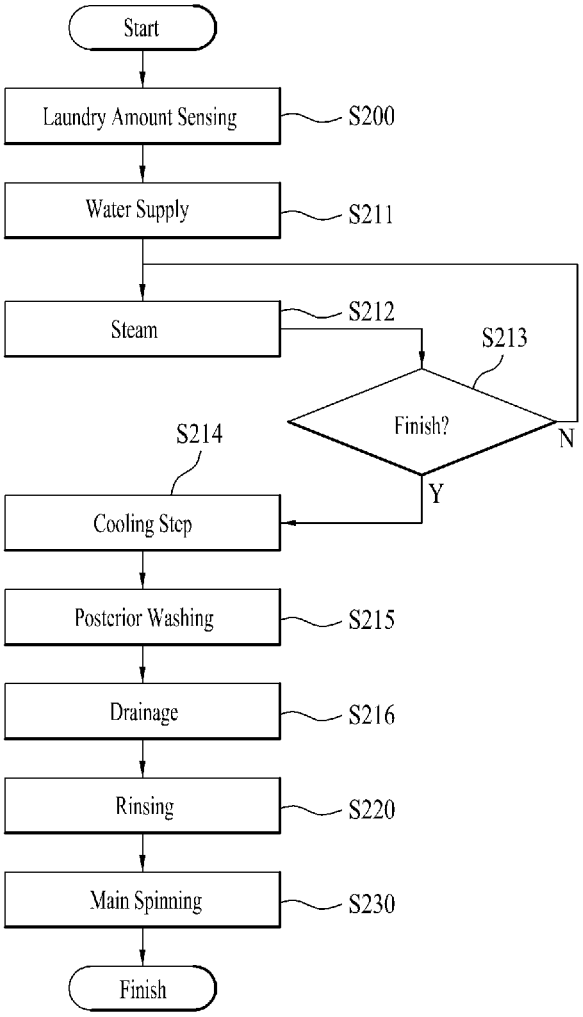
FIGS. 15 and 16 are flow charts illustrating a course and a finish operation pattern of the steam generator according to one embodiment of the present invention.
Figure 16:
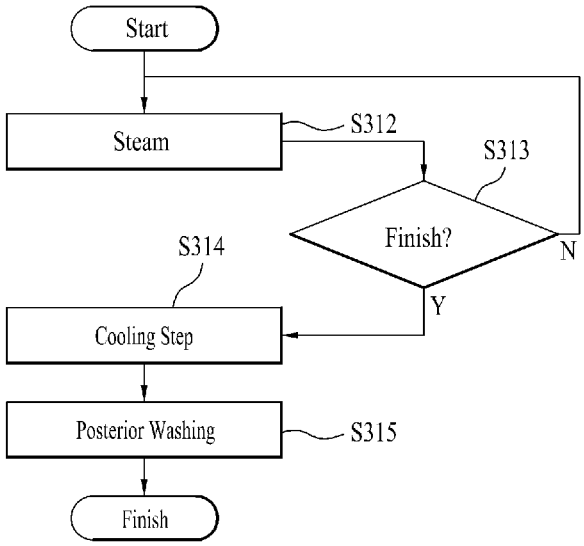

Referring to FIGS. 15 and 16, embodiments of a course having a steam cycle will be described as follows.

First of all, referring to FIG. 15, a washing course using wash water, especially, a steam washing course including a steam cycle will be described.

Once washing preparation is complete after wash water is loaded into an object accommodation part, one of various washing courses is selected and the selected washing course starts.

After the washing course starts, the amount of laundry that is an object of the washing, namely, the laundry amount is selected (S200). Based on the detected laundry amount, wash water for washing is supplied to a tub or a drum (S211). Simultaneously with the water supply or after the water supply, laundry soaking is performed for a predetermined time. After the laundry soaking, a post-washing (S215) or a main washing is performed. After the main washing, water drainage is performed and a washing cycle is complete. After the washing cycle, a rinsing cycle (S220) and a spinning cycle or a main-spinning (S230) may be performed sequentially, only to finish the washing course.

The washing course is a normal washing course in which washing is performed by using only wash water. A steam washing course having a steam cycle added thereto may be selected and performed.

As mentioned in reference to the steam generator according to the first embodiment, steam is generated in quite a fast time period and the generated steam is supplied. Accordingly, the duration time of the course may be prevented from being increased by the steam cycle.

More specifically, the steam cycle (S212 and S213) may be performed between the water supply 211 and the posterior washing (S215). In other words, the steam cycle may be performed during the laundry soaking step. That is, the steam cycle may be performed before the posterior washing (S215) performed in a state of no adding wash water.

The steam washing course is a course configured to perform washing by using wash water and steam. Accordingly, water may be supplied to the steam generator during the water supply 211. Meanwhile, the steam washing course requires a much amount of steam. For example, the steam cycle is performed to supply steam to the drum until the temperature inside the drum reaches a preset temperature. Of course, the steam cycle may be performed for a preset time period. In any cases, the water supply to the steam generator and the heating of the supplied water may be repeated when the large amount of steam is required.

Once the steam cycle finishes after that, the heating is not performed any longer. In this instance, the finish of the steam cycle means that the steam cycle is performed until the temperature inside the drum reaches the preset temperature or the steam cycle is performed for the preset time period. In other words, a preset condition is satisfied and the steam is not supplied to the object accommodation part any more. When the preset condition is satisfied only to finish the steam cycle performed by the steam generator, it is preferred that the control unit performs a cooling step for cooling the housing by supplying water to the housing for a preset time. In other words, once the steam cycle finishes, a cooling step (S214) for additionally supplying water to the steam generator may be performed. That is because the point of finishing the steam cycle may be the point of converting all of the water within the steam generator into steam. In this instance, it is necessary to solve the overheating of the steam generator. Accordingly, the cooling step (S214) for supplying water to the steam generator for a shorter time period than the time preset for supplying water to the steam generator to generate steam. At this time, the water supply time in the cooling step may be 1 second, for example. The steam cycle in the steam washing course may include a water supplying step for generating steam and a cooling step (S214) to solve an overheating problem after the steam cycle finishes.

The steam cycle in the steam washing source will be described in detail as follows.

Referring to FIG. 16, a refresh course will be described. Such a refresh course is a course using no wash water. In other words, the refresh course is typically the course configured to refresh dried clothes or clothes having little moisture. In the refresh course, clothes may not be wet completely.

A steam cycle provided in the refresh course may be performed until a preset condition is satisfied. In other words, steam is generated (S312) and it is determined that the preset condition is satisfied (S313). Based on the result of the determination, the steam cycle finishes.

In this instance, the steam cycle may include a cooling step (S314) after the heating finishes.

The refresh course may include a heated air supplying step performed before the steam cycle (S312 and S313) and various posterior cycles (S315) after the steam cycle. The posterior cycle may be a cycle for driving the drum for a preset time period. The posterior cycle may be the cycle configured to supply heated air, cold air or combination of the heated air and the cold air for a preset time period.

The refresh course finishes after such the posterior cycles are complete.

Meanwhile, a finish pattern of the steam cycle provided in the refresh course may be identical to the finish patter of the steam cycle provided in the steam washing course. Similarly, that is because it is necessary to prevent the overheating of the steam generator.

The steam cycle in the refresh course will be described in detail later.

Figure 19:
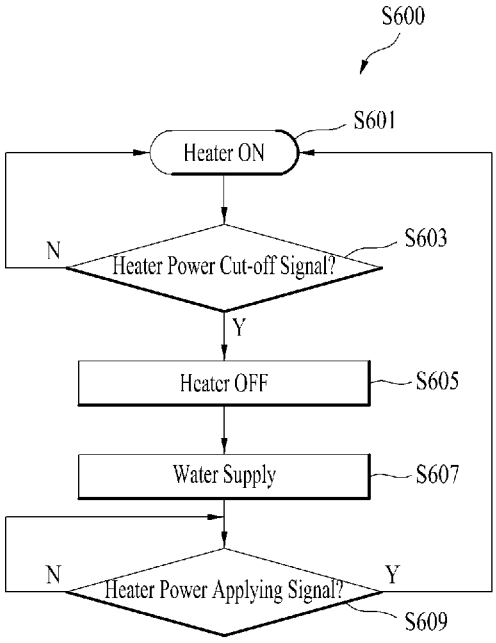
FIG. 19 is a flow chart illustrating heater control according to one embodiment of the present invention.

Referring FIG. 19, a heater controlling algorithm (S600) according to one embodiment in the steam cycle will be described in detail. The heater control algorithm (S600) includes a step of controlling the heater of the steam generator to be on (S601), a step of controlling the heater to be off according to the heater power cut off signal (S601), a step of supplying water to the steam generator (S607), and a step of controlling the heater to be on according to the heater power applying signal.

First of all, after or before the water supply to the steam generator according to a selected course, the power is applied to the heater of the steam generator (S601). That is, the controller 141 described in reference to FIG. 11 switches on the heater switch 142 and the power is applied to the heater.

When all of the water is converted into steam, the temperature of the steam generator, especially, the temperature of the housing is drastically increased. The control unit 140 may be configured to generate the heater cut off signal when the temperature of the housing reaches a first preset temperature. Such heater power cut off signal may be realized by the control signal generator 145.

Accordingly, the controller 141 determines whether the heater power cut off signal is generated (S603). When the heater power cut off signal is generated based on the result of the determination, the controller 141 cuts off the power of the heater (S605). The controller 141 cuts off the power of the heater by controlling the heater switch 142.

Once the power of the heater is cut off, the controller 141 controls water to be supplied to the steam generator for a preset time period (TO) (S607). In other words, the controller 141 cuts off the power of the heater provided in the steam generator according to the heater power cut off signal and it starts the water supply to the steam generator. At this time, the power cut-off of the heater and the water supply may be performed simultaneously. Once the water supply starts, the temperature of the housing is getting lowered and the heater power cut off signal is converted into the heater power applying signal (S609). Accordingly, the controller 141 re-applies the power to the heater (S6010) and it controls the heating and the water supply to be repeated. Of course, the repetition of the heating and water supply may be performed until the steam cycle finishes.

The finish of the steam cycle may be determined based on a preset time or a target temperature of the drum. In the refresh course, a dryness level or a moisture containing amount of clothes may be determined by a dryness level sensor.

Accordingly, when it is determined that the steam cycle finishes, the power of the heater is controlled to be cut off finally.

In this instance, the heating (S601), the heating stop (S605) and the water supply (S607) may be continuously repeated until the steam cycle finishes. The water supply control may be performed based on the water supply time. Such the repetition may be performed identically in the steam cycle, regardless of the selected course.

Referring to FIGS. 14 and 15, when such the steam cycle finishes, the cooling step (S214 and S314) for relieving the overheating of the steam generator may be performed commonly. In the cooling step, additional water supply may be performed to relieve the overheating of the steam generator. Also, the low water pressure compensating algorithm mentioned above may be performed before or during such the repetition process and it is preferred that the low water pressure compensating algorithm is performed before the steam cycle starts. The low water pressure compensating algorithm may prevent the repetition of the heating and water supply from being performed excessively.

Figure 17:
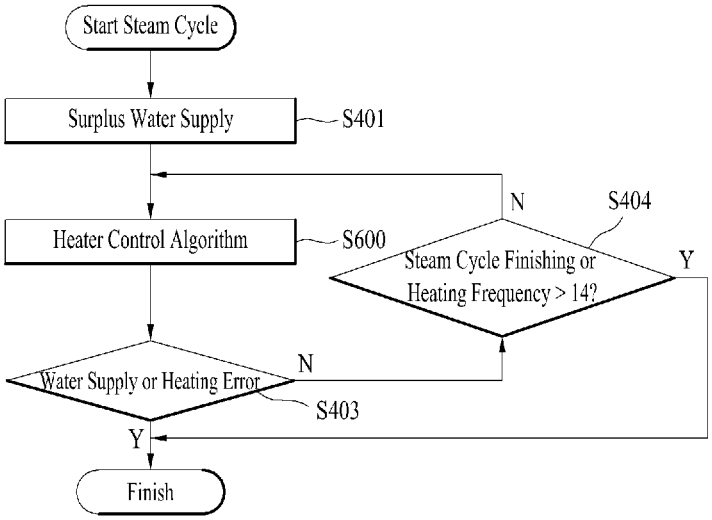
FIGS. 17 and 18 are flow charts illustrating an initial operation pattern of the steam generator according to one embodiment of the present invention.

Referring to FIG. 17, the steam cycle in the steam washing course will be described in detail as follows. The steam cycle in the steam washing course may start from a step of supplying water to the steam generator for a predetermined time. In other words, the steam cycle starts from the water supply, not the heating. At this time, the water supplying step may be a surplus water supply step (S401).

The water supply is controlled to be performed for a predetermined time period (TO). However, the surplus water supply (S401) may be performed for a longer time than the preset time (TO) and the amount of the supplied water is larger than the capacity of the steam generator. Accordingly, the water overflows from the steam generator and the overflowing water is drawn into the object accommodation part. Such the surplus water supply (S401) may be performed simultaneously with the water supply (S211) to the drum shown in FIG. 15 or it may be performed until the water supply (S211) to the drum finishes. In other words, wash water is supplied by the steam generator and the water remaining after the surplus water supply is heated to start steam generation.

In this instance, the surplus water supply (S401) may perform following functions. A large amount of steam is required in the steam washing cycle and a large amount of water is heated to generate such a large amount of steam. This means the repetition of heating. Accordingly, foreign substances such as scale are likely to accumulate in the steam generator and the surplus water supply (S410) may perform a function of washing the inside of the steam generator.

Meanwhile, when the heating starts after the surplus water supply (S401), the heated water might be drawn into the object accommodation part. However, the laundry is wet by the wash water already as mentioned above and damage to the object may be prevented accordingly.

Figure 18:
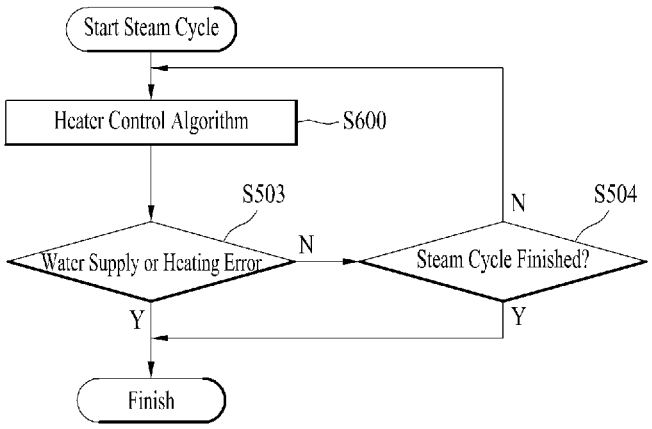

After the surplus water supply, the heater control algorithm (S600) described in reference to FIG. 18 is performed. Together with that, when the heating of the heater starts according to the heater control algorithm (S600), a water supply error or heating error may be sensed (S503). When the water supply or heating error is sensed, the steam cycle finishes. However, unless the water supply or heating error is sensed, it is determined whether the condition of the steam cycle is satisfied (S504) and the water supply and the heating of the heater control algorithm (S600) are repeated.

Such the repetition of the water supply and heating may be performed when the steam cycle condition is satisfied. The steam cycle condition may be a target temperature inside the drum or the steam cycle time. Also, the steam cycle condition may be determined based on the frequency of repeating the water supply or heating of the heater control algorithm (S600). FIG. 17 shows that the repetition frequency is 14, for example.

The water supply (S401) of the heater control algorithm (S600) may be controlled based on the predetermined time (TO). Meanwhile, the determination of the water supply or heating error (S403) may be enabled by the temperature sensor 160 shown in FIG. 4.

After the water supply, the temperature of the steam generator has to be lowered. When the heating starts, the temperature of the steam generator has to be heightened. The water supply or heating error may be determined based on such a lowered temperature value or heightened temperature value or a change rate of the temperatures.

For example, when the temperature is increased too high after the heating starts, it may be determined as water supply error. In other words, it means that water fails to be supplied properly. In contrast, even when the increase of the temperature is very slow after the heating starts, it may be determined as water supply error. In other words, it means that water supply is performed continuously. Also, even when the temperature decrease is quite slow after the water supply performed after the heating, it means that water fails to be supplied properly.

Meanwhile, when the temperature increase is not generated in the heating, it may be determined as heater or heating error.

The temperature sensor may be a thermistor. Such a thermistor may determine not only a threshold but also the present temperature. The temperature sensor may sense the temperature at a specific point of the time. Accordingly, the controller 141 may calculate a temperature change rate based on the plurality of the sensing times and the sensing temperature data easily. The controller 141 may figure out the water supply or heater error based on the temperature data at a specific point or the temperature change rate using the temperature data.

Referring to FIG. 18, the steam cycle in the refresh course will be described in detail as follows. The steam cycle in the refresh course starts from the heating of the heater control algorithm (S00). That is, it starts from the heating not the water supply. Accordingly, the initial steam generator driving pattern is different from the initial steam generator driving pattern of the steam cycle in the steam washing course mentioned above. In the steam cycle composing the refresh course starts, the heating starts not the water supply, to prevent the water supplied and heated in the steam generator from being supplied to the object accommodation part. In other words, the water is supplied to the steam generator to a predetermined water level or higher and the heating starts. After that, the heated water may be supplied to the object accommodation part via the outlet. In the refresh course, dried clothes or clothes having little moisture are loaded into the object accommodation part and the heated water might damage to the clothes. Accordingly, in the refresh course, the heater of the steam generator is heated and such concern of fabric damage may be solved.

When the steam cycle starts by the heating of the heater control algorithm (S600), posterior steps may be identical to the steam cycle in the steam washing course mentioned above. Specifically, the water supply or heating error determining step (S503) may be identical to the embodiment mentioned above.

Similarly, the steam cycle finish condition determining step (S504) may be the same. However, the steam cycle finish condition may be differentiated in the steam washing course or in the refresh course. That is because the amount of steam required in the refresh course may be relatively small.

Specifically, the steam washing course may control the steam cycle to finish when the target temperature inside the drum is reached. The refresh course may control the steam cycle to finish when the preset time is reached. However, when the preset conditions are satisfied, the steam cycle finishes in all of the steam washing course and the refresh course.

Meanwhile, as mentioned above, the refresh course is configured to supply steam to dried clothes. When hot water is supplied to the dried clothes, heat damage might be generated in a surface of clothes. Accordingly, it is quite important in the refresh course to prevent the water heated by the steam generator from being supplied to the object accommodation part.

The steam cycle may finish, regardless of the amount of the water provided in the steam generator. In other words, a large amount of water might remain in the steam generator because the steam cycle finishes during the water supply. Also, the steam cycle might finish as soon as the heating starts. In this instance, a large amount of water may remain.

It is likely for a new refresh course to be performed in the state of the water remaining in the steam generator. When the water supply is performed in the steam cycle in this instance firstly, the remaining hot water might be supplied to the object accommodation part together with the supplied water.

Similarly, when the water supply is performed firstly, a water level inside the steam generator is close to the steam outlet 112 or overflowing. At this time, the heating starts to generate steam and the heated water might be supplied to the object accommodation part.

To solve those problems, it is preferred in this embodiment that the heating is performed first without the water supply, when the steam cycle starts in the refresh course.

Meanwhile, the cooling step may be performed after the steam cycle finishes in the steam washing course and the refresh course. In other words, as mentioned in reference to FIGS. 15 and 16, it is preferred that the cooling step is performed to relieve the overheating of the steam generator after the steam cycle finishes.

The water supply time in the steam cycle of the steam washing course and the refresh course is set to be preset time (T1). When the low water pressure compensating algorithm is performed before the steam cycle, the water supply time may be changed into the compensated water supply time (Tsupply).

Meanwhile, the steam cycle of each course meant in the present specification is the cycle configured to supply steam to the object accommodation part at least one time or more by supplying water to the steam generator to supply steam to the object accommodation part or by switching on the heater of the steam generator. The frequency of the steam supply in the steam cycle may be differentiated according to the purpose of each course. In other words, steam may be repeatedly supplied a predetermined number of times by the water supply or heating the heater in one steam cycle. The steam supply cycle configured of the water supply and the heating or the heating and the water supply in one steam cycle may be repeated at least one time according to the course. The finish of the steam cycle means that the purpose of the steam cycle in each course is achieved not to supply steam to the object accommodation part any more. For example, the steam cycle of the steam washing course may finish when the temperature inside the drum reaches the preset temperature. Also, the steam cycle of the refresh course may finish when a dryness level or a humidity level of clothes loaded in the drum satisfies a preset condition. In other words, the finishing of the steam cycle means that the preset condition preset in each course is satisfied not to supply steam any more.

What is claimed is:

1. A home appliance comprising:

a steam generator to generate steam and to supply the generated steam to an object accommodation part where an object is accommodated, wherein the steam generator comprises:

a housing to accommodate water supplied thereto, the housing comprising a base for defining a bottom surface and a sidewall coupled to a lateral surface of the base to form a heating space where the water accommodated in the housing is heated;

a drain formed in the sidewall to drain the water inside the housing outside;

a heater to heat the water accommodated in the housing by heating the housing to generate steam; and a control unit to cut off or apply an electric power of the heater based on the temperature of the housing, wherein the heater is embedded in the base, wherein the control unit comprises:

a control signal generator provided at a side of the housing and configured to generate a heater power control signal based on the temperature of the housing, and a heater controller configured to cut off or apply the power of the heater based on the control signal, wherein the control signal generator generates a heater power cut off signal when the temperature of the housing reaches a first preset temperature, and the heater controller cuts off the power supplied to the heater based on the heater power cut off signal, wherein the control signal generator generates a heater power applying signal when the temperature of the housing is lowered to a second preset temperature from the first preset temperature, and the heater controller applies the power supplied to the heater based on the heater power applying signal, and wherein the second preset temperature is over the boiling point of water but lower than the first preset temperature.

2. The home appliance according to claim 1, wherein the control unit controls water to be supplied to the housing when the temperature of the housing reaches the first preset temperature that is over the boiling point of water.

3. The home appliance according to claim 1, wherein the heater comprises, at least two heater terminals having the power connected thereto and a heating line provided between the heater terminals to emit heat to heat the housing, and the heating line is embedded in the base and the heater terminals are provided in the same lateral surface of the base.

4. The home appliance according to claim 1, further comprising:

an overheat preventer provided in the housing to cut off the power supplied to the heater when the temperature of the housing reaches a third preset temperature over the first preset temperature.

5. The home appliance according to claim 4, wherein the overheat preventer is connected to the line of the power supplied to the heater in serial and cuts off the power supplied to the heater, regardless of the control performed by the control unit, when the temperature of the housing reaches the third preset temperature.

6. The home appliance according to claim 3, wherein the heater controller comprises, a heater switch provided on the line of the power supplied to the heater to selectively cut off or apply the power supplied to the heater; and a controller controls the heater switch based on the control signal of the control signal generator.

7. The home appliance according to claim 6, wherein the overheat preventer comprises a first overheat preventer connected between the heater switch and the heater in serial.

8. The home appliance according to claim 7, wherein the overheat preventer comprises a second overheat preventer connected between the controller and the heater in serial.

9. The home appliance according to claim 8, wherein the overheat preventer is a thermostat.

10. The home appliance according to claim 1, wherein the control signal generator is a thermostat.

11. The home appliance according to claim 1, wherein the control unit controls cooling of the housing by supplying water to the housing for a predetermined time, when a steam cycle performed by the steam generator finishes after a predetermined condition is satisfied.

12. A controlling method of a washing machine to perform a low water pressure compensating algorithm to supply a proper amount of water to a steam generator of a home appliance, the low water pressure compensating algorithm comprising:

a water supply step to supply water to the steam generator for a preset water supply time;

a power applying step to apply power to a heater of the steam generator;

a sensing time counting step to count the sensing time taken for the temperature of the housing to reach a first preset temperature that is over the boiling point of water, after the power of the heater is applied; and a determining step to determine the water pressure of a water supply source as a low water pressure when the sensing time is shorter than a preset time.

13. The controlling method of the washing machine according to claim 12, further comprising:

a water supply time compensating step to increase the water supply time by adding a compensated time to the preset water supply time when the water pressure of the water supply source is a low water pressure.

14. The controlling method of the washing machine according to claim 13, wherein the low water pressure compensating algorithm is re-performed according to the water supply time compensated in the water supply time compensating step, and the low water pressure compensating algorithm finishes when the sensing time is the preset time or longer.

15. The controlling method of the washing machine according to claim 12, further comprising:

a sensing frequency to count a number of the low water pressure when the sensing time is shorter than the preset time, a water supply time compensating step to increase the water supply time by adding a compensated time to the preset water supply time when the sensing frequency is a preset number of times or more.

16. The controlling method of the washing machine according to claim 12, wherein the low water pressure compensating algorithm is performed before supplying a steam.

17. The controlling method of the washing machine according to claim 12, wherein the low water pressure compensating algorithm is performed, after the housing is heated by applying the power to the heater of the steam generator until the temperature of the housing is over the boiling point of water.

* * * * *